US007339105B2

(12) United States Patent
Eitaki

(10) Patent No.: US 7,339,105 B2
(45) Date of Patent: Mar. 4, 2008

(54) AUTOMATIC MUSICAL PERFORMANCE DEVICE

(75) Inventor: Shu Eitaki, Hamamatsu (JP)

(73) Assignee: Kabushiki Kaisha Kawai Gakki Seisakusho, Hamamatsu-shi (JP)

( * ) Notice: Subject to any disclaimer, the term of this patent is extended or adjusted under 35 U.S.C. 154(b) by 0 days.

(21) Appl. No.: 10/589,856

(22) PCT Filed: Nov. 29, 2004

(86) PCT No.: PCT/JP2004/017686

§ 371 (c)(1),
(2), (4) Date: Aug. 17, 2006

(87) PCT Pub. No.: WO2005/081221

PCT Pub. Date: Sep. 1, 2005

(65) Prior Publication Data

US 2007/0163426 A1 Jul. 19, 2007

(30) Foreign Application Priority Data

Feb. 19, 2004 (JP) ..... 2004-042261

(51) Int. Cl.
*G10H 1/00* (2006.01)
*G10H 7/00* (2006.01)

(52) U.S. Cl. ..... 84/615; 84/639; 84/724; 84/653

(58) Field of Classification Search ..... 84/615, 84/639, 724, 653
See application file for complete search history.

(56) References Cited

U.S. PATENT DOCUMENTS 5,530,198 A * 6/1996 Ishii ..... 84/21
5,583,310 A * 12/1996 Sugiyama et al. ..... 84/719
5,627,333 A * 5/1997 Stahnke et al. ..... 84/462
5,648,621 A * 7/1997 Sasaki ..... 84/171
5,650,580 A * 7/1997 Yamamoto et al. ..... 84/21

(Continued)

FOREIGN PATENT DOCUMENTS

JP 4 170591 6/1992

(Continued)

*Primary Examiner*—Lincoln Donovan
*Assistant Examiner*—David S. Warren
(74) *Attorney, Agent, or Firm*—Oblon, Spivak, McClelland, Maier & Neustadt, P.C.

(57) ABSTRACT

Provide an automatic musical performance device, which is capable of giving a concert magic function in an acoustic instrument with a feeling of normally playing the acoustic instrument.

A time period Tv between two points, and a tempo Tmp found based on a time intervals between two-point detection and later two-point detection, are found based on detection signals at the two points and later detection signals at the two points; and a delay time fD(Tv), which is from reception of each operating signal by a solenoid activating circuit 20 to commencement of a musical performance of an acoustic piano by the circuit 20, and a velocity value fv(Tv, Tmp) are found based on functions. A time period Ta, which starts at the time of later detection $S_1$ in two-point detection as a reference and ends when a lever 19 is inverted, is found as fa(Tv) based on a function. Each operating signal is transmitted to the solenoid activating circuit 20 under such timing control that a transmission timing Ton comes at a time of lapse of "fa(Tv)−fD(Tv)" sec after the later detection; and the velocity value is set at fv(Tv, Tmp).

12 Claims, 11 Drawing Sheets

U.S. PATENT DOCUMENTS

| | | | | |
|---|---|---|---|---|
| 5,714,702 | A * | 2/1998 | Ishii | 84/462 |
| 5,739,450 | A * | 4/1998 | Fujiwara et al. | 84/462 |
| 6,051,762 | A * | 4/2000 | Fujiwara et al. | 84/21 |
| 6,075,196 | A * | 6/2000 | Fujiwara et al. | 84/645 |
| 6,229,081 | B1 * | 5/2001 | Ura et al. | 84/462 |
| 6,271,447 | B1 * | 8/2001 | Fujiwara et al. | 84/21 |
| 6,297,437 | B1 * | 10/2001 | Ura et al. | 84/423 R |
| 6,359,207 | B1 * | 3/2002 | Oba et al. | 84/658 |
| 6,417,439 | B2 * | 7/2002 | Uehara et al. | 84/645 |
| 6,472,589 | B1 * | 10/2002 | Lee | 84/21 |
| 6,737,571 | B2 * | 5/2004 | Furukawa | 84/610 |
| 6,750,389 | B2 * | 6/2004 | Hagiwara et al. | 84/631 |
| 2001/0007221 | A1 * | 7/2001 | Uehara | 84/649 |
| 2002/0178898 | A1 * | 12/2002 | Hagiwara et al. | 84/664 |
| 2005/0145104 | A1 * | 7/2005 | Sasaki | 84/746 |
| 2005/0235808 | A1 * | 10/2005 | Ishii et al. | 84/600 |
| 2006/0130640 | A1 * | 6/2006 | Fujiwara | 84/626 |
| 2006/0196346 | A1 * | 9/2006 | Ohba et al. | 84/616 |

FOREIGN PATENT DOCUMENTS

| | | |
|---|---|---|
| JP | 5 204379 | 8/1993 |
| JP | 6 95661 | 4/1994 |
| JP | 7 271355 | 10/1995 |
| JP | 10 161648 | 6/1998 |
| JP | 10 240241 | 9/1998 |
| JP | 2000 352972 | 12/2000 |
| JP | 2002 189467 | 7/2002 |
| JP | 2003 36078 | 2/2003 |
| JP | 2003 271140 | 9/2003 |

* cited by examiner

| | |
|---|---|
| First bite | Key number |
| Second bite | Step time |
| Third bite | Gate time |
| Forth bite | Velocity |

AUTOMATIC MUSICAL PERFORMANCE DEVICE

TECHNICAL FIELD

The present invention relates to an automatic musical performance device, which is capable of automatically playing music by operating a commanding member at certain intervals.

BACKGROUND ART

Heretofore, the applicant has proposed that an electronic keyboard, such as an electronic piano, can have a function, called concert magic, of automatically playing music by involving a player in the performance and by operating a commanding member at certain intervals.

On the other hand, in the case of an acoustic piano, there has been proposed only one that has an automatic performance function of playing music once the music performance has started, even if a player is not involved in the music performance.

DISCLOSURE OF INVENTION

Problems that the Invention is to Solve

When the above-mentioned concert magic function is applied to an acoustic piano instead of an electronic piano, there have been caused, e.g., problems that depressed keys produce sounds independently from the sounds of an automatically played musical piece and that a certain amount of delay (about 100 msec) is always caused since the concert magic function fails to produce a sound immediately after (substantially the same time as) a depressed key produces a sound unlike an electronic piano (the reason of which is that the respective keys of a piano are provided with solenoids for automatic musical performances, and that a time lag is caused until a solenoid is activated to produce the relevant sound after reception of the relevant signal).

With respect to the former problem of the independent production of a sound, JP-A-2003-271140 has proposed that one to plural keys, which are provided with a touch sensor, are muted (are affected by a hammer stopper) to realize the concert magic function.

However, it has been impossible to solve the latter problem of a delay in sound generation timing even by this proposal.

Unless a delay in sound generation timing is solved, it is impossible to utilize the concert magic function to enjoy an automatic musical performance while a player is playing a musical instrument with a feeling of normally playing the musical instrument.

The present invention has been proposed in consideration of the above-mentioned problems. It is an object of the present invention is to provide an automatic musical performance device, which is capable of utilizing the concert magic function to play an acoustic instrument with a feeling of normally playing the acoustic instrument.

Means for Solving the Problem

The automatic musical performance device according to the present invention is basically characterized to comprises:

a musical instrument capable of presenting an acoustic performance;

a performance actuator for actuating the musical instrument based on an operating signal from outside;

a memory unit for storing automatic musical performance data wherein a plurality of musical note data are arranged in the order of sound generation;

a command unit for commanding progress of an automatic musical performance;

a commanding member equipped with the instrument and being capable of being operated by a player;

a detector for detecting an operational action of the commanding member between at least two points; and a musical performance operation control unit, which has functions or data map tables stored therein, which makes a calculation on detection results based on mapping relationships in the functions or the data map tables, which sequentially reads out musical note data forming an automatic musical performance data from the memory unit whenever the command unit gives a command, and which outputs each operating signal to the performance actuator based on the read-out musical note data and the calculated values;

wherein the musical performance operation control unit finds a time period Tv between the two points based on detection by the detector; a delay time fD(Tv), which is from reception of each operating signal by the performance actuator to commencement of an actual musical performance of the musical instrument by the performance actuator, is found based on the mapping relationship in a function or a data map table; a time period Ta, which starts when later detection of the detection is made and ends when the operational action of the commanding member is stopped, is found as fa(Tv) based on the mapping relationship in a function or a data map table; and; and each operating signal is transmitted to the performance actuator under such timing control that a transmission timing Ton comes at a time of lapse of "fa(Tv)−fD(Tv)" sec after the later detection.

In accordance with the above-mentioned structure, the performance control unit finds the time period Tv between at least two points (the distance between which is at least previously known) based on the respective detection signals at the two points detected by the detector. The delay time fD(Tv), which is from reception from each operating signal by the performance activator to commencement of the actual musical performance of the musical instrument by the performance activator, is found based on the mapping relationship in a function or a data map table in the musical performance control unit by the performance control unit. The time period Ta, which starts when later detection is made and ends when the operational action of the commanding member is stopped (the moving distance of the commanding member is at least previously known) is found as fa(Tv) based on the mapping relationship in a function or a data map table also equipped in the performance control unit, by the performance control unit. And, each operating signal is transmitted to the performance actuator under such timing control that the transmission timing Ton comes at the time of lapse of "fa(Tv)−fD(Tv)" sec from the later detection.

On other words, when the time interval Tv between the two points is found based on the detection signals, it is possible to calculate the operating speed of the commanding member and the value of Ta(=fa(Tv)) since the positions of the two holes in the lever 19, and the moving distance of the commanding member, which starts at detection of the later signal and ends when the lower edge of the protrusion 191 of the lever 19 is brought into contact with the bottom of the hollow portion 194, are known. Further, it is also possible to find the delay time fD(Tv), which is from reception of each operating signal by the performance actuator to the commencement of actual performance that the musical instrument plays with the performance actuator. Thus, the performance control unit transmits each operating signal to the performance actuator under such timing control that the transmission timing comes at the time of the lapse of "fa(Tv)−fD(Tv)" sec after the later signal detection. At the time of the lapse of the delay time fD(Tv), the performance by the acoustic instrument starts. Since at that time, the operating action of the commanding member has been stopped (e.g., when the commanding member is similar to a keyboard, a key of the keyboard has depressed to the lowest position), the time lag, which is from activation of a solenoid after reception of each operating signal to sound generation, is accordingly cancelled so that a player can enjoy the automatic musical performance with the concert magic function (which is an automatic musical performance function that whenever the command unit outputs a command, the performance control unit sequentially reads out, from the memory unit, musical note data forming the automatic musical performance data and outputs operating signals to the performance actuator based on the read-out musical note data to present an automatic musical performance) while playing the musical instrument with a feeling of normally playing the musical instrument.

The commanding member may be similar to a keyboard having a longer stroke than an ordinary keyboard (Claim 2). In this mode, the detector detects operation at two points, which are spaced in the stroke (the detector comprises a two-point switch for detecting operation at each of two points, which are spaced in the stroke), and the performance control unit finds, as detection values Tv, time intervals between detection signals based on the detection signals detected at the two points by the detector. A delay time fD(Tv), which is from reception of each operating signal by the performance actuator to commencement of an actual musical performance of the musical instrument by the performance actuator, is found based on the mapping relationship in a function or a data map table, and a time period Ta, which starts when later detection of the detection is made and ends when the key release operation of the commanding member is started, is found as fa(Tv) based on the mapping relationship in a function or a data map table. Further, each operating signal is transmitted to the performance actuator under such timing control that a transmission timing Ton comes at the time of lapse of "fa(Tv)−fD(Tv)" sec after the later detection. Specifically, the automatic musical performance device according to the present invention may comprise:

a musical instrument capable of presenting an acoustic performance;

a performance actuator for actuating the musical instrument based on an operating signal from outside;

a memory unit for storing automatic musical performance data wherein a plurality of musical note data are arranged in the order of sound generation;

a command unit for commanding progress of an automatic musical performance;

a commanding member equipped with the instrument, being capable of being operated by a player and being similar to a keyboard having a longer stroke than an ordinary keyboard;

a detector for detecting an operational action of the commanding member between at least two points, which are spaced in the stroke; and a musical performance operation control unit, which has functions or data map tables stored therein, which makes a calculation on detection results based on mapping relationships in the functions or the data map tables, which sequentially reads out musical note data forming an automatic musical performance data from the memory unit whenever the command unit gives a command, and which outputs each operating signal to the performance actuator based on the read-out musical note data and the calculated values;

wherein the performance control unit finds, as detection values Tv, time intervals between detection signals based on the detection signals detected at the two points by the detector; a delay time fD(Tv), which is from reception of each operating signal by the performance actuator to commencement of an actual musical performance of the musical instrument by the performance actuator, is found based on the mapping relationship in a function or a data map table; a time period Ta, which starts when later detection of the detection is made and ends when the operational action of the commanding member is stopped, is found as fa(Tv) based on the mapping relationship in a function or a data map table; and each operating signal is transmitted to the performance actuator under such timing control that a transmission timing Ton comes at a time of lapse of "fa(Tv)−fD(Tv)" sec after the later detection.

The detector may comprise light emitting elements and light receiving elements, two pairs of which are located at two upper and lower positions to scan light in a horizontal direction at the two upper and lower positions above a playing portion of the musical instrument (Claim 3). In this mode, the operational action of a player is detected by preventing the scanned light from being received by the light receiving elements at the two positions. The performance control unit finds, as a detection values Tv, time intervals between detection signals based on the detection signals, and a delay time fD(Tv), which is from reception of each operating signal by the performance actuator to commencement of an actual musical performance of the keyboard instrument by the performance actuator, is found based on the mapping relationship in a function or a data map table. A time period Ta, which starts when a lower light receiving element is prevented from receiving light and ends when key-release operation is started, is found as fa(Tv) based on the mapping relationship in a function or s data map table; and the operating signal is transmitted to the performance actuator under such timing control that a transmission timing Ton comes at the time of lapse of "fa(Tv)−fD(Tv)" sec after the lower light receiving element is prevented from receiving the light. Specifically, the automatic musical performance device according to the present invention may comprise:

a musical instrument capable of presenting an acoustic performance;

a performance actuator for actuating the musical instrument based on an operating signal from outside;

a memory unit for storing automatic musical performance data wherein a plurality of musical note data are arranged in the order of sound generation;

a command unit for commanding progress of an automatic musical performance;

a detector comprising light emitting elements and light receiving elements, two pairs of which are located at two upper and lower positions to scan light in a horizontal direction at the two upper and lower positions above a playing portion of the musical instrument in order to detect an operational action of a player by preventing the scanned light from being received by the light receiving elements at the two positions; and a musical performance operation control unit, which has functions or data map tables stored therein, which makes a calculation on detection results based on mapping relationships in the functions or the data map tables, which sequentially reads out musical note data forming an automatic musical performance data from the memory unit whenever the command unit gives a command, and which outputs each operating signal to the performance actuator based on the read-out musical note data and the calculated values;

wherein the performance control unit finds, as a detection values Tv, time intervals between detection signals based on the detection signals detected by the detector; a delay time fD(Tv), which is from reception of each operating signal by the performance actuator to commencement of an actual musical performance of the keyboard instrument by the performance actuator, is found based on the mapping relationship in a function or a data map table; a time period Ta, which is equal to be half a time period starting when a lower light receiving element is prevented from receiving the scanned light and ending when the lower light receiving element is prevented from receiving the scanned light again by inversion of the operational action of the player, is found as fa(Tv) based on the mapping relationship in a function or a data map table; and each operating signal is transmitted to the performance actuator under such timing control that a transmission timing Ton comes at a time of lapse of "fa (Tv)−fD(Tv)" sec after the lower light receiving element is prevented from receiving the scanned light.

On the other hand, as the tempo of a musical piece gets faster, the detection value Tv of the time interval between the at least two points detected by the detector as described above decreases in general (the operating speed of the commanding member increases). When the calculation is made based on the detection values without modification, the velocity is too large at a fast tempo in some cases.

In order to cope with this problem in such a case, the tempo of the operation of the commanding member (actually, the time intervals between two-point detection and later two-point detection made by the detector and a tempo Tmp found by averaging the time intervals, based on detection signals at the two points and later detection signals at the two points) is found, and the actual velocity value is found as fv(Tv, Tmp) by referring to the mapping relationship in a function or a data map table based on the tempo (which should be considered) and the detection value Tv. In this case, the delay time fD(Tv) is also found as fD(Tv) based on a mapping relationship in the functions or the data map tables. And, each operating signal is transmitted under such timing control that a transmission timing Ton comes at the time of lapse of "fa(Tv)−fD(Tv)" sec after the later detection.

The invention defined in Claim 4 provides a structure for preventing the velocity value from having an excessive value and specifically may comprise:

a musical instrument capable of presenting an acoustic performance;

a performance actuator for actuating the musical instrument based on an operating signal from outside;

a memory unit for storing automatic musical performance data wherein a plurality of musical note data are arranged in the order of sound generation;

a command unit for commanding progress of an automatic musical performance;

a commanding member equipped with the instrument and being capable of being operated by a player;

a detector for detecting an operational action of the commanding member between at least two points; and a musical performance operation control unit, which has functions or data map tables stored therein, which makes a calculation on detection results based on mapping relationships in the functions or the data map tables, which sequentially reads out musical note data forming an automatic musical performance data from the memory unit whenever the command unit gives a command, and which outputs each operating signal to the performance actuator based on the read-out musical note data and the calculated values;

wherein the musical performance operation control unit finds a time period Tv between two points, time intervals between two-point detection and later two-point detection and a tempo Tmp found by averaging the time intervals, based on detection signals at the two points and later detection signals at the two points; a delay time fD(Tv), which is from reception of each operating signal by the performance actuator to commencement of an actual musical performance of the musical instrument by the performance actuator, and a velocity value fv(Tv, Tmp) are found based on mapping relationships in the functions or the data map tables; a time period Ta, which starts when later detection of the two-point detection as a reference is made and ends when the operational action of the commanding member is stopped, is found as fa(Tv) based on a mapping relationship in the functions or the data map tables; each operating signal is transmitted to the performance actuator under such timing control that a transmission timing Ton comes at a time of lapse of "fa(Tv)−fD(Tv)" sec after the later detection; and the velocity value is set at fv(Tv, Tmp).

It should be noted that the tempo Tmp may be a time difference between first two-point detection (detection at one of the two points or detection at the other point in first detection) and second two-point detection (detection at one of the two points or detection at the other point in second detection) or the average value of time differences between adjacent beats detected several beats before, as defined in the above-mentioned structure.

In some cases, the above-mentioned structure is set in such a fast tempo that the value of the transmission timing Ton, which is equal to "fa(Tv)−fD(Tv)", has a negative value. In such cases, each operation signal may be transmitted, delayed by one beat $T_2$, i.e., at the next beat timing to solve the timing shift.

Claim 7 provides such a structure, which is specifically configured so that when the transmission timing found by the performance control unit has a negative value, each operating signal is transmitted to the performance actuator with a delay of one beat $T_2$ under such timing control that the transmission timing Ton comes at a time of lapse of "fa (Tv)+$T_2$−fD(Tv)" sec after the later detection in the two-point detection as a reference. Specifically, the structure may comprise:

a musical instrument capable of presenting an acoustic performance;

a performance actuator for actuating the musical instrument based on an operating signal from outside;

a memory unit for storing automatic musical performance data wherein a plurality of musical note data are arranged in the order of sound generation;

a command unit for commanding progress of an automatic musical performance;

a commanding member equipped with the instrument and being capable of being operated by a player;

a detector for detecting an operational action of the commanding member between at least two points; and a musical performance operation control unit, which has functions or data map tables stored therein, which makes a calculation on detection results based on mapping relationships in the functions or the data map tables, which sequentially reads out musical note data forming an automatic musical performance data from the memory unit whenever the command unit gives a command, and which outputs each operating signal to the performance actuator based on the read-out musical note data and the calculated values;

wherein the musical performance operation control unit finds a time period Tv between two points, time intervals between two-point detection and later two-point detection and a tempo Tmp found by averaging the time intervals, based on detection signals at the two points and later detection signals at the two points; a delay time fD(Tv), which is from reception of each operating signal by the performance actuator to commencement of an actual musical performance of the musical instrument by the performance actuator, and a velocity value fv(Tv, Tmp) are found based on mapping relationships in the functions or the data map tables; a time period Ta, which starts when later detection of the two-point detection as a reference is made and ends when the operational action of the commanding member is stopped, is found as fa(Tv) based on a mapping relationship in the functions or the data map tables; in case where it is assumed that a transmission timing Ton, when the operating signal is transmitted after later detection, is at a time of lapse of "fa(Tv)−fD(Tv)" sec after the later detection, when the transmission timing has a negative value, each operating signal is transmitted to the performance actuator with a delay of one beat $T_2$ under such timing control that the transmission timing Ton comes at the time of lapse of "fa(Tv)+$T_2$−fD(Tv)" sec after the later detection in the two-point detection as the reference; and the velocity value is set at fv(Tv, Tmp).

It should be noted that the one beat $T_2$ may be a time difference between first two-point detection (detection at one of the two points or detection at the other point in first detection) and second two-point detection (detection at one of the two points or detection at the other point in second detection) or the average value of time differences between adjacent beats detected several beats before, as in the tempo Tmp.

By having such a structure, the current operation of the commanding member reflects on the performance presented in one beat.

However, even when such a structure is adopted, the automatic musical performance device is problematic, in some cases, in that a musical performance is presented by one beat without a pause when the operation action of the commanding member is suddenly stopped. In order to ease this problem, it may be considered that a next operating signal is transmitted after detecting that the operation of the commanding member is inverted to lift the commanding member after the operating action of the commanding member is once stopped. Specifically, on the assumption that the detection unit is configured to make two-point detection so that first detection is made by the switch $S_1$ and second detection is made by the switch $S_2$, each operating signal is transmitted only when it is detected that $S_1$ is turned off in such a sequence that $S_1$ is turned on, $S_2$ is turned on, the transmission of the operating signal at the next beat is prepared, $S_2$ is turned off, $S_1$ is turned off and the operating signal is transmitted. In accordance with this arrangement, a musical performance is not presented at the next beat when the commanding member suddenly gets still without inversion (when the commanding member comprises a key, the key is suddenly held, being depressed).

Claim 10 provides such a structure, which is specifically configured so that whenever the detector is turned on, signals are detected at the respective points; and when it is detected that all detection signals are off, each operating signal is transmitted to the performance actuator under the above-mentioned timing control. Specifically, the structure may comprise:

a musical instrument capable of presenting an acoustic performance;

a performance actuator for actuating the musical instrument based on an operating signal from outside;

a memory unit for storing automatic musical performance data wherein a plurality of musical note data are arranged in the order of sound generation;

a command unit for commanding progress of an automatic musical performance;

a commanding member equipped with the instrument and being capable of being operated by a player;

a detector for detecting an operational action of the commanding member between at least two points; and a musical performance operation control unit, which has functions or data map tables stored therein, which makes a calculation on detection results based on mapping relationships in the functions or the data map tables, which sequentially reads out musical note data forming an automatic musical performance data from the memory unit whenever the command unit gives a command, and which outputs each operating signal to the performance actuator based on the read-out musical note data and the calculated values;

wherein whenever the detector is turned on, signals are detected at the respective points; when it is detected that all detection signals are off, detection signals at the two points and later detection signals at the two points are defined; the musical performance operation control unit finds a time period Tv between two points, time intervals between two-point detection and later two-point detection and a tempo Tmp found by averaging the time intervals, based on the detection signals at the two points and the later detection signals at the two points; a delay time fD(Tv), which is from reception of each operating signal by the performance actuator to commencement of an actual musical performance of the musical instrument by the performance actuator, and a velocity value fv(Tv, Tmp) are found based on mapping relationships in the functions or the data map tables; a time period Ta, which starts when later detection of the two-point detection as a reference is made and ends when the operational action of the commanding member is stopped, is found as fa(Tv) based on a mapping relationship in the functions or the data map tables; in case where it is assumed that a transmission timing Ton, when the operating signal is transmitted after later detection, comes at the time of lapse of "fa(Tv)−fD(Tv)" sec after the later detection, when the transmission timing has a negative value, each operating signal is transmitted to the performance actuator with a delay of one beat $T_2$ under such timing control that the transmission timing Ton comes at the time of lapse of "fa(Tv)+$T_2$−fD(Tv)" sec after the later detection; and the velocity value is set at fv(Tv, Tmp).

Each of Claim 5, Claim 8 and Claim 11 defines that the commanding member is similar to a keyboard having a longer stroke than an ordinary keyboard, that the detector detects the operational action of the commanding member at two points, which are spaced in the stroke, and that the performance control unit finds, as detection values Tv, time intervals between detection signals based on the detection signals detected at the two points by the detector in each of the automatic musical performance device defined in Claim 4, Claim 7 and Claim 10.

Each of Claim 6, Claim 9 and Claim 12 defines that the detector comprises light emitting elements and light receiving elements, two pairs of which are located at two upper and lower positions to scan light in a horizontal direction at the two upper and lower positions above a playing portion of the musical instrument in order to detect an operational action of a player by preventing the scanned light from being received by the light receiving elements at the two positions; and that the performance control unit finds, as a detection values Tv, time intervals between detection signals based on the detection signals in each of the automatic musical performance device defined in Claim 4, Claim 7 and Claim 10.

EFFECT OF THE INVENTION

In accordance with the automatic musical performance device according to the present invention defined in any one of Claims 1 to 12, it is possible to have an advantage in that a player can enjoy the automatic musical performance with the concert magic function while playing a musical instrument with a feeling of normally playing the musical instrument.

In accordance with the structure defined in any one of Claim 4, Claim 5 and Claim 6, it is possible to prevent the velocity value from being an excessive value even if a musical piece has a fast tempo. Accordingly, a player can enjoy the automatic musical performance with the concert magic function while playing a musical instrument with a feeling of normally playing the musical instrument.

In accordance with the structure defined in any one of Claim 7, Claim 8 and Claim 9, when the structure is set in such a fast tempo that the value of the transmission timing Ton, which is equal to "fa(Tv)−fD(Tv)", has a negative value, each operation signal is transmitted, delayed by one beat $T_2$, i.e., at the next beat timing, with the result that the current operation of the commanding member reflects on the performance presented in one beat.

Further, in accordance with the structure defined in any one of Claim 10, Claim 11 and Claim 12, in a case where the structure defined in any one of Claim 7, Claim 8 and Claim 9 is adopted, even when the operation action of the commanding member is suddenly stopped, a next operating signal is transmitted after detecting that the operation of the commanding member is inverted to lift the commanding member after the operating action of the commanding member is once stopped, with the result that it is possible to eliminate the discomfort in a musical performance by preventing the musical performance from being presented by one beat without a pause.

EXPLANATION OF REFERENCE NUMERALS

Figure 1:
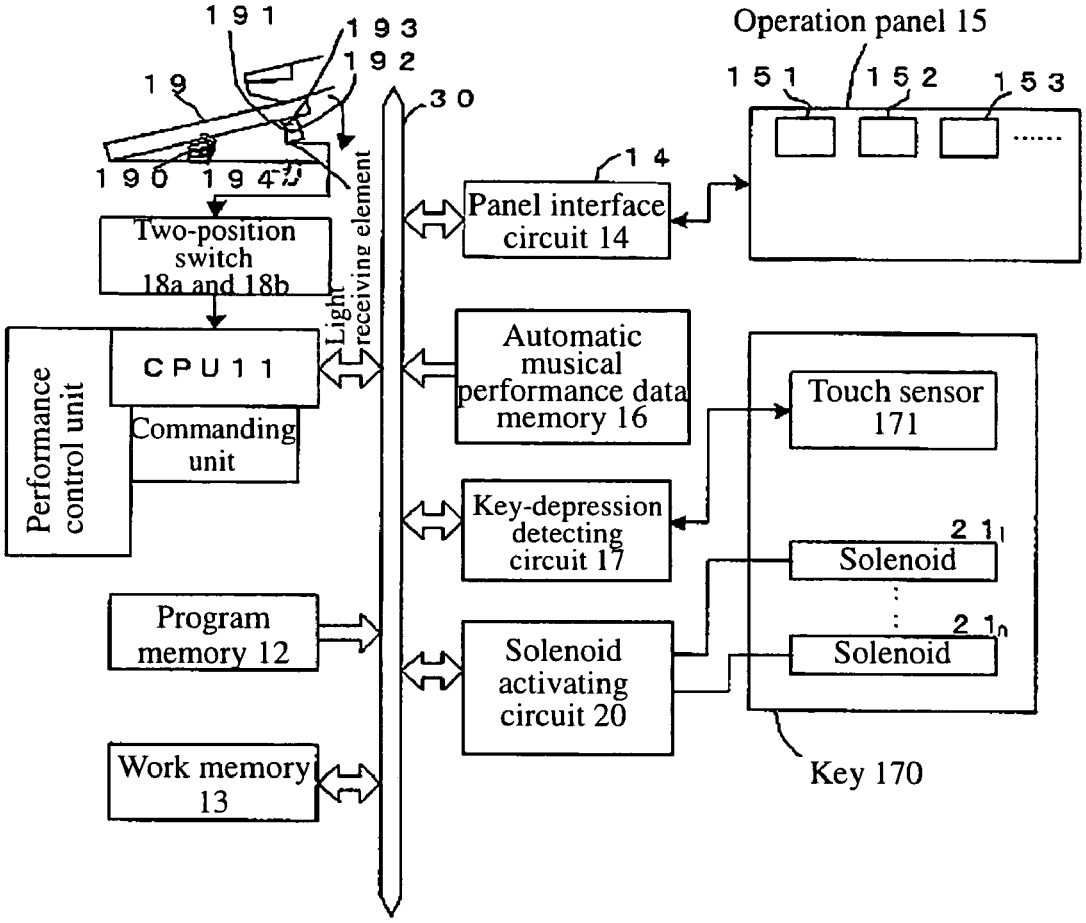
FIG. 1 is a schematic circuit diagram explaining a case where the acoustic instrument with an embodiment of the present invention applied thereto comprises an acoustic piano.

11 CPU
12 program memory
13 work memory
14 panel interface circuit
15 operation panel
16 automatic musical performance data memory
17 key-depression detecting circuit
18*a* and 18*b* two-point switch
19 lever
20 solenoid activating circuit
$\mathbf{21}_1$ to $\mathbf{21}_n$ solenoid
40 key-depression mechanism
41 jack
42 wippen
43 hammer
44 chord
151 automatic performance switch
152 CM switch
153 musical piece selection switch
170 key
171 touch sensor
180*a* and 181*b* light emitting element
181*a* and 181*b* light receiving element
191 protrusion of lever
192 and 193 hole
194 hollow portion
195 shielding member

BEST MODE FOR CARRYING OUT THE INVENTION

Now, the automatic musical performance device according to the best mode for carrying out the invention will be described in detail, referring to the accompanying drawings.

Embodiment 1

Embodiment 1 will be described about a case where the acoustic instrument with the automatic musical performance device according to the present invention applied thereto comprises an acoustic piano. The acoustic instrument with the present invention applied thereto is not limited to an acoustic piano but is applicable to another keyboard instrument capable of an acoustic performance, such as an acoustic organ or an acoustic cembalo.

FIG. 1 is a block diagram showing the electrical structure of the automatic musical performance device according to this embodiment of the present invention. The automatic musical performance device is configured so that a central processing unit (hereinbelow, referred to as "the CPU") 10, a program memory 12, a work memory 13, a panel interface circuit 14, an automatic musical performance data memory 16 as a memory for storing the automatic musical performance data for the present invention, a key-depression detecting circuit 17 and a solenoid activating circuit 20 forming the performance actuator according to the present invention are connected one another by a system bus 30. The system bus 30 is used to transmit and receive address signals, data signals, control signals and the like.

The CPU 11 controls the entire automatic musical performance device by being operated according to the control program stored in the program memory 12. By reading out an automatic musical performance program stored in the program memory 12 and executing the program, the CPU 11 forms the command unit and the musical performance control unit according to the present invention. The details of the operation performed by the CPU 11 will be described in detail later, referring to flowcharts.

Figure 4:
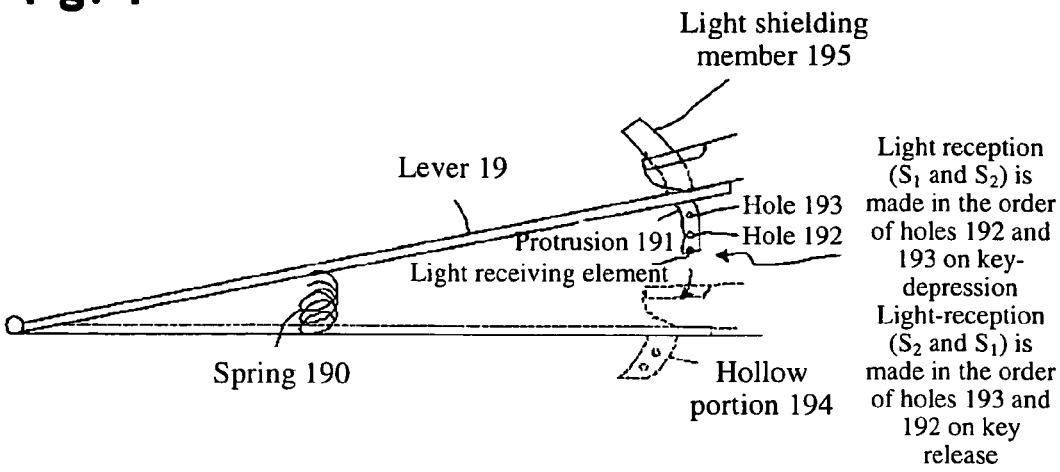
FIG. 4 is a schematic view of the structure of a lever 19 in Embodiment 1.

The CPU 11 is connected to a light receiving element which has a two-point switch 18*a* and 18*b* as the detector according to the present invention. As shown in FIG. 4, the two-point switch 18*a* and 18*b* detects the operational state of a lever 19 as the commanding member according to the present invention. Specifically, the acoustic piano has the lever 19 disposed on a right side of the keyboard, the lever having one end pivotally mounted so as to be held at a certain position by a spring 190 and having a protrusion 191 formed in the vicinity of the other end so as to protrude downward. The protrusion 191 has two holes 192 and 193 formed therein in the pivotal direction for detection of signals $S_1$ and $S_2$ described later. The two-point switch 18*a* and 18*b* as the detector according to the present invention is constituted by a combination of the two holes $S_1$ and $S_2$, and an optical switch (comprising a pair of light emitting element and light receiving element), which is fixed at a certain position to detect signals by receiving light passing laterally through the respective holes 192 and 193 when the lever 19 is depressed. Under the protrusion 191 of the lever 19, a hollow portion 194 is bored so as to completely house the protrusion 191 so that when the lever 19 has been depressed into the lowest position (indicated by dotted lines in this figure), the lowest end of the protrusion 191 is brought into contact with the bottom of the hole portion 194. Although the detector is formed by the optical switch in this embodiment as stated above, the detector is not limited to be such a specific switch as long as the detector comprises a switch capable of making two-point detections, such as a rubber switch or a leaf switch.

The program memory 12 comprises a read-only memory (hereinbelow, referred to as "the ROM"). The program memory 12 stores various kinds of data to be referred to by the CPU 11 in addition to the above-mentioned control program and automatic musical performance program.

The work memory 13 comprises a random access memory (hereinbelow, referred to as "the RAM") for example. The work memory is used to temporarily store various kinds of data when the CPU 11 performs various kinds of operations. The work memory 13 has registers, counters, flags and the like defined therein. The main elements among them will be described. Elements other than the elements described below will be described whenever needed.

(a) an automatic musical performance flag, which stores whether a normal automatic musical performance is being presented or not (b) a concert magic flag (hereinbelow, referred to as "the CM flag"), which stores whether a concert magic musical performance (hereinbelow, referred to as "the CM mode") is being presented or not (c) a performance request flag, which stores that the lever 19 has been depressed (d) a first musical note data pointer, which holds the address in the automatic musical performance data memory 16, to which the musical note data for the normal automatic musical performance which is currently being presented, is assigned (e) a second musical note data pointer (which holds the address in the automatic musical performance data memory 16, to which the musical note data for the concert magic musical performance, which is currently being presented, is assigned (f) a first song number register, which stores the song number of a selected automatically played musical piece for the normal automatic musical performance (g) a second song number register, which stores the song number of a selected automatically played musical piece for the concert magic musical performance The panel interface circuit 14 is connected to an operation panel 15. The operation panel 15 has switches, such as an automatic performance switch 151, a concert magic switch (hereinbelow, referred to as "the CM switch") 152 and a musical piece selection switch 153, disposed thereon. An LED indicator for indicating the setting status of each of the switches, an LCD for indicating various kinds of messages, and another device are also disposed on the operation panel, although not shown.

The automatic performance switch 151 comprises, e.g., a push-bottom switch, and the automatic performance switch is used to selectively start and stop the normal automatic musical performance. The on/off status of the automatic performance switch 151 is stored by the automatic performance flag. The automatic performance flag is inverted whenever the automatic performance switch 151 is depressed. In other words, when the automatic performance switch is depressed while the normal automatic musical performance is stopped (the automatic performance flag is turned off), the automatic performance flag is turned on, and the normal automatic musical performance starts. On the other hand, when the automatic performance switch is depressed while the normal automatic musical performance is being presented (the automatic performance flag is turned on), the automatic performance flag is turned off, the normal automatic musical performance stops.

The CM switch 152 comprises, e.g., a push-bottom switch, and this switch is used to designate whether the concert magic performance should be presented or not. The setting status of the CM switch 152 is stored by the CM flag. The CM flag is inverted whenever the CM switch 152 is depressed. In other words, when the CM switch is depressed while the keyboard instrument is not in the CM mode (the CM flag is turned off), the CM flag is turned on, and the keyboard instrument is shifted to the CM mode. On the other hand, when the CM switch 152 is depressed while the keyboard instrument is in the CM mode (the CM flag is turned on), the CM flag is turned off, and the CM mode is released.

The musical piece selection switch 153 comprises a switch, such as a ten key, a dial or an up/down switch, to which numerical inputs are acceptable. The musical piece selection switch 153 is used to select a desired music piece under the normal automatic musical performance or the concert magic performance among plural musical pieces for automatic musical performance.

The panel interface circuit 14 scans the respective switches on the operation panel 15 in response to a command from the CPU 11, and the panel interface circuit prepares panel data corresponding to the respective switches in one bit based on the signals indicating the on/off status of the respective switches obtained by the scanning operation. Each bit represents a switch-on state by "1" and a switch-off state by "0" for example. The panel data are transmitted to the CPU 11 through the system bus. The panel data are used to determine whether an on-event or an off-event has occurred in connection with each of the switches of the operation panel 15 (the details of which will be described later).

The panel interface circuit 14 also provides the LED indicator and the LCD on the operation panel 15 with display data transmitted from the CPU 11. Thus, according to the data transmitted from the CPU 11, the LED indicator is turned on/off, and a message is displayed in the LCD.

The automatic musical performance data memory 16 comprises, e.g., a ROM, and the automatic musical performance data memory corresponding to the memory unit according to the present invention. The automatic musical performance data memory 16 stores a plurality of automatic musical performance data corresponding to such plural musical pieces. The automatic musical performance data comprise plural musical note data arranged in the order of sound generation. The respective musical note data are used to generate one sound comprise, e.g., 4-bite data shown in FIG. 2.

The respective bites are allotted to a key number, a step time, a gate time and a velocity. The highest-order bit of the "key number" is used to designate note-on or note-off. The lower seven bits of the key number correspond to the number allotted to each key of the keyboard instrument and are used to designate a pitch. The "step time" is used to designate a time when sound generation starts (hereinbelow, referred to as the "sound generation timing"). The "gate time" is used to designate the length of a sound (a sound length). The "velocity" is used to specify the intensity of a sound. An automatic musical performance data comprises such musical note data arranged in the order of step time values.

Although these automatic musical performance data are common to the normal automatic musical performance and the concert magic performance, the "step time" is not used in the concert magic performance. The "velocity" is not used in the concert magic performance either. As described later, the "velocity" uses a velocity value, which is generated on the basis of the time interval Tv between two points found based on detection signals detected by two point detection of the two-point switch 18*a* and 18*b*, and is modified with a detected tempo (tmp) data. The respective automatic musical performance data are accompanied by an identifier called "song number". For example, 1 to 500 are allotted to the song numbers of the musical pieces for the normal automatic musical performance, and 501 to 999 are allotted to the song numbers of the musical pieces for the concert magic performance. A user can specify a song number with the selection switch 153 on the operation panel 15 to select his or her desired musical piece. The song number of a selected musical piece is set in the first song number register in the case of the normal automatic musical performance and in the second song number register in the case of the concert magic performance.

The automatic musical performance data memory 16 is not limited to a ROM and may comprise a storage medium, such as a RAM, a ROM card, a RAM card, a flexible disk or a CD-ROM. When the automatic musical performance data memory 16 comprises a flexible disk or a CD-ROM having a relatively longer access time, it is preferred that the automatic musical performance data stored in the flexible disk or the CD-ROM be downloaded in a RAM before being used.

Figures 2, 3:
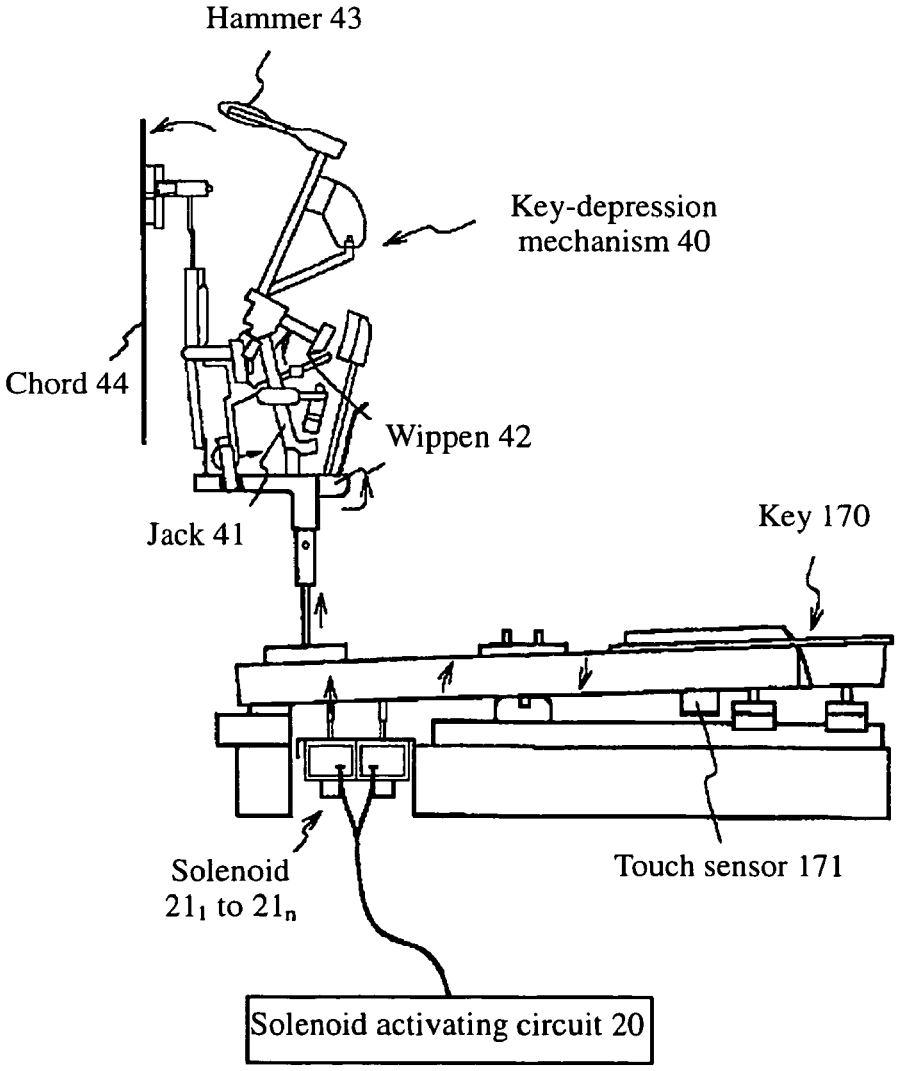
FIG. 2 is a schematic view showing a structure of a musical note data.
FIG. 3 is a schematic view of the key-depression mechanism for the acoustic piano according to this embodiment.

The key-depression detecting circuit 17 is connected to a touch sensor 171 mounted to each key of the keyboard 170. As shown in FIG. 3, each touch sensor 171 is disposed on a lower position of each key. Each touch sensor 171 detects which key is depressed and how first the depression speed is. Based on the detection, each touch sensor generates a key-depression signal and transmits the key-depression signal to the key-depression detecting circuit 17.

Each touch sensor 171 may comprise an optical sensor, a pressure sensor or another sensor, which can detect that the relevant key is depressed. When the key-depression detecting circuit 17 receives a key-depression signal from a touch sensor 171, the key-depression detecting circuit transmits the key-depression signal as a keyboard data to the CPU 11.

The solenoid activating circuit activates solenoids $\mathbf{21}_1$ to $\mathbf{21}_n$ disposed on the respective keys of the keyboard 170. The performance actuator according to the present invention comprises the solenoid activating circuit 20 and the solenoids $\mathbf{21}_1$ to $\mathbf{21}_n$. As shown in FIG. 3, each of the solenoids $\mathbf{21}_1$ to $\mathbf{21}_n$ is disposed on a rear portion of each of the keys. Each key is pushed up when the relevant activating signal is supplied by the solenoid activating circuit 20. This operation produces the same state as a player depresses a key.

When a key is pushed up by supply of the relevant activating signal from the solenoid activating circuit 20, the motion of the key is transmitted as indicated by arrows shown in FIG. 3 to activate the relevant key-depression mechanism 40 comprising a jack 41, a wippen 42, a hammer 43 and the like, with the result that the chord 44 corresponding to the depressed key is struck. Thus, a sound is produced from the acoustic piano.

On the other hand, the solenoid activating circuit 20 receives an operating signal as described below, with the result that solenoids $\mathbf{21}_1$ to $\mathbf{21}_n$ mounted to the respective keys are activated. Specifically, as shown in FIG. 4, the lever 19 is pivotally mounted through the spring 190 on the right side of the keyboard of the acoustic piano. At the same time that the lever 19 is depressed, the protrusion 191, which projects downward from the lever 19, moves toward the hollow portion 194 thereunder, and the lower side of the lever 19 is finally brought into contact with the bottom of the hollow portion 194. When the player ceases to depress the lever 19, the lever is returned to the original position by the spring 190.

Figure 5:
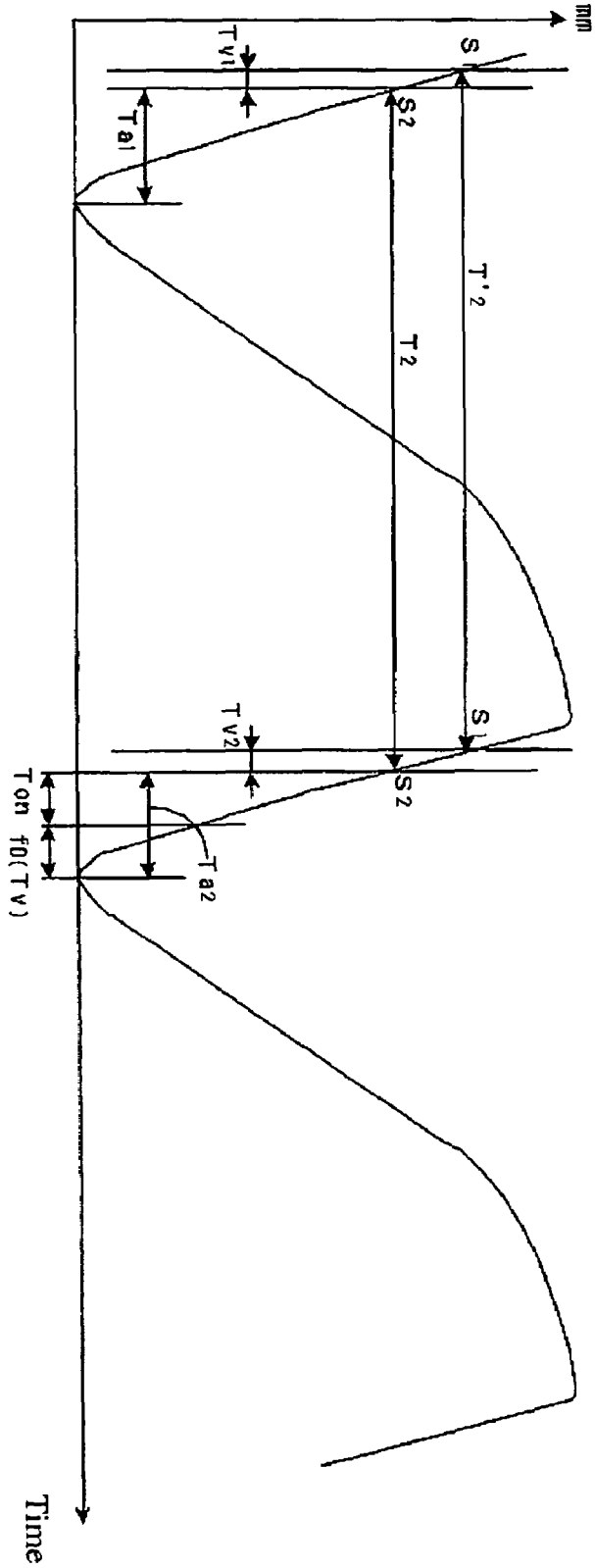
FIG. 5 is a timing chart showing a switch stroke in the case of the lever 19 according to Embodiment 1.

During this time period, when the lever 19 is depressed, light, which is emitted from the light-emitting element of the optical switch, sequentially passes through the two holes 192 and 193 formed in the protrusion 191 and is received by the light-receiving element, being detected as a signal $S_1$ and a signal $S_2$ in this order as shown in FIG. 5. On the other hand, when the player ceases to depress the lever after the lowest end of the protrusion 191 of the lever 19 is brought into contact with the bottom, the light, which is emitted from the light-emitting element of the optical switch, passes through the holes in the reverse order and is received by the light-receiving element, being detected as the signal $S_2$ and the signal $S_1$ in the reverse order. When the lever is depressed next, the above-mentioned signal detection processing is repeated. It should be noted that a shielding member 195 is disposed on the side of the lever remote from the protrusion 191, which prevents a case where light, which has emitted from the light-emitting element, is received by the light-receiving element when the lever 19 is depressed to arrive at, e.g., the lowest position (the light-receiving element also receives light at portions other than the hold 192 and 193 without the provision of the shielding member).

The operation, which is performed by the embodiment according to the present invention, will be described, referring to FIG. 4 and FIG. 5.

According to data, the time lag between reception of performance information by an acoustic piano and actual sound generation is about 100 msec. If it is assumed that the lever 19 has a stroke of 100 mm, the time period required for round trip and the time period required for one way are 1,000 msec and 500 msec, respectively, at a tempo of 60, the time period required for round trip and the time period required for one way are 500 msec and 250 msec, respectively, at a tempo of 120, and the time period required for round trip and the time period required for one way are 300 msec and 150 msec, respectively, at a tempo of 200.

In the concert magic performance, the lever 19 is vertically moved to control the tempo and the intensity as in a baton. In this case, the time period between reception of the signal $S_2$ and the moment when the lowest end of the protrusion 191 of the lever 19 is brought into contact with the bottom is reduced as the tempo becomes faster. When a player wants to make a large sound, the time period between the signal $S_1$ and the signal $S_2$ is reduced, and the time period between reception of the signal $S_2$ and the moment when the lowest end of the protrusion 191 of the lever 19 is brought into contact with the bottom is also reduced. When the timing that the lever 19 has been brought into contact with the bottom coincides with the timing of the beat of the music played by a player (the sound generation timing of musical notes matched to the beat), the player can have a natural feeling of musical performance.

When a player manipulates the lever 19 shown in FIG. 4 as in the baton carried by a conductor in a musical performance, the lever 19 is moved as shown in FIG. 5. While the lever is moving, the signals $S_1$ and $S_2$ are detected by the two-point switch 18*a* and 18*b*. Subsequent signals $S_1$ and $S_2$ are detected as having a motion similar to the continuous motion of a baton.

When these signals are input into the performance control unit formed by the CPU 11, the CPU 11 finds light-receiving time intervals Tv in reception of passing light in the two holes 192 and 193 formed in the protrusion 191 of the lever 19 (time intervals between $S_1$ and $S_2$, which comprise first measurement $Tv_1$ and second measurement $Tv_2$). The time intervals correspond to the intensity, with which the lever 19 is depressed.

The CPU 11 also finds a time interval $T'_2$ or $T_2$ (a time interval, at which the signal $S_1$ or $S_2$ is turned on) between the signal $S_1$ or $S_2$ in the first measurement and the signal $S_1$ or $S_2$ in the second measurement. At the time that the signal $S_1$ or $S_2$ in the second measurement is received, the tempo Tmp of a musical piece played by the concert magic performance may be determined as $60/T'_2$ or $60/T_2$, as described later. The tempo Tmp of a musical piece played by the concert magic performance may be determined as the average of the values of $60/T'_2$ or $60/T_2$, which are found by calculation made whenever such signals are received at several times.

$Ta_1$ and $Ta_2$ shown in FIG. 5 indicate respective time periods, each of which starts at reception of the signal $S_2$ and ends when the lower end of the protrusion 191 of the lever 19 has been brought into contact with the bottom. The position of the light-receiving element forming the two-point switch 18*a* and 18*b*, and the position of the bottom of the hollow portion 194 are both stationary positions as shown in FIG. 4, and the distance between both positions is previously known. $Ta_1$ or $Ta_2$ is found based on the distance by referring to a prepared function (or a prepared data map table) stored in the program memory 12. The position of the bottom of the hollow portion 194 may be set as a parameter changeable according to a user's desire since the position of the bottom varies from player to player.

The above-mentioned tempo Tmp is normally determined as $60/T_2$ or $60/T'_2$. As described above, $60/T_2$ or $60/T'_2$ may be a value, which is obtained by averaging several measured values. $60/T_2$ or $60/T'_2$ is used as the performance tempo Tmp of a musical piece played by the concert magic performance after commencement of a musical performance.

The above-mentioned key-depression intensity is found as fv(Tv) based on the relevant light receiving time interval Tv by causing the CPU 11 to refer to a function (or a data map table) stored in the program memory 12 (examples of the intensity: from 1 to 128 corresponding to the velocity of MIDI).

On the other hand, the delay time that is from the reception of an operating signal by the solenoid activating circuit 20 to sound generation caused by activation of solenoids $\mathbf{21}_l$ to $\mathbf{21}_n$ is found as fD(Tv) based on the relevant light receiving time interval Tv by causing the CPU 11 to refer to a function (or a data map table) stored in the program memory. Although the delay time is generally about 100 msec, the delay time may increase or decrease according to the depression intensity.

As described above, the time period $Ta_1$ or $Ta_2$, which starts at reception of the signal $S_2$ and ends when the lower end of the protrusion 191 of the lever 19 is brought into contact with the bottom, is found as fa(Tv) by causing the CPU 11 to refer to a function (a data map table) stored in the program memory 12, since the distance between the light receiving element and the bottom of the hollow portion 194 is previously known.

From this point of view, the CPU 11 performs, as the performance control unit, to transmit each operating signal to the solenoid activating circuit 20 (performance activating unit) under such timing control that a transmission timing Ton, when each operating signal is transmitted to the solenoid activating circuit 20 after each signal $S_2$ is received (turned on), comes at the time of the lapse of "Ta−fD(Tv)" sec or the lapse of "fa(Tv)−fD(Tv)" sec after detection thereof.

When the time interval Tv between the two points is found based on the signals $S_1$ and $S_2$, it is possible to calculate the operating speed of a commanding member and the value of Ta(=fa(Tv)) since the positions of the two holes in the lever 19 (the distance between both holes), and the moving distance of the lever, which starts at detection of each signal $S_2$ and ends when the lower edge of the protrusion 191 of the lever 19 is brought into contact with the bottom of the hollow portion 194, are known. Further, it is also possible to find the delay time fD(Tv), which is from reception of each operating signal by the solenoid activating circuit 20 to the commencement of actual performance that the acoustic piano plays with solenoids $\mathbf{21}_1$ to $\mathbf{21}_n$. Thus, the performance control unit formed by the CPU 11 transmits each operating signal to the solenoid activating circuit 20 under such timing control that the transmission timing comes at the time of the lapse of "fa(Tv)−fD(Tv)" sec after detection of the signal $S_2$. At the time of the lapse of the delay time fD(Tv), the performance by the acoustic piano starts. Since the lever 19 has depressed to the lowest poison at that time, the time lag, which is from activation of any one of solenoids $\mathbf{21}_1$ to $\mathbf{21}_n$ after reception of the operating signal to sound generation, is accordingly cancelled so that a player can enjoy the automatic musical performance with the concert magic function while playing the piano with a feeling of normally playing the piano.

As the tempo of a musical piece gets faster, the value Tv detected as the time interval of the signals $S_1$ and $S_2$ detected as described above gets generally shorter (the operating speed of the lever 19 gets higher). When the detected value is used without modification, the velocity gets too large at a fast tempo in some cases.

From this point of view, in such cases, the tempo Tmp given by operating the lever 19 is found, and the velocity value to be actually used is found, as a value of fv(Tv, Tmp), by referring to a function (or the mapping in a data map table) stored in the program memory 12 based on the tempo (which should be considered) and the detection value Tv.

In such cases, the delay time Ton for each of solenoids $\mathbf{21}_1$ to $\mathbf{21}_n$ is also accordingly determined as fD(Tv) based on the relevant function (or the mapping relationship in the relevant data map table). Each operating signal is transmitted to the solenoid transmitting circuit 20 with such timing control that the transmission timing Ton, when each operating signal is transmitted since each signal $S_2$ is detected, comes at the time of the lapse of "fa(Tv)−fD(Tv)" sec from detection thereof.

Even if the tempo of a musical piece is fast, the above-mentioned operation can be performed to enjoy an automatic musical performance utilizing the concert magic performance while playing with a feeling of normally playing the piano, since it is possible to prevent the velocity from abnormally increasing.

Figure 7:
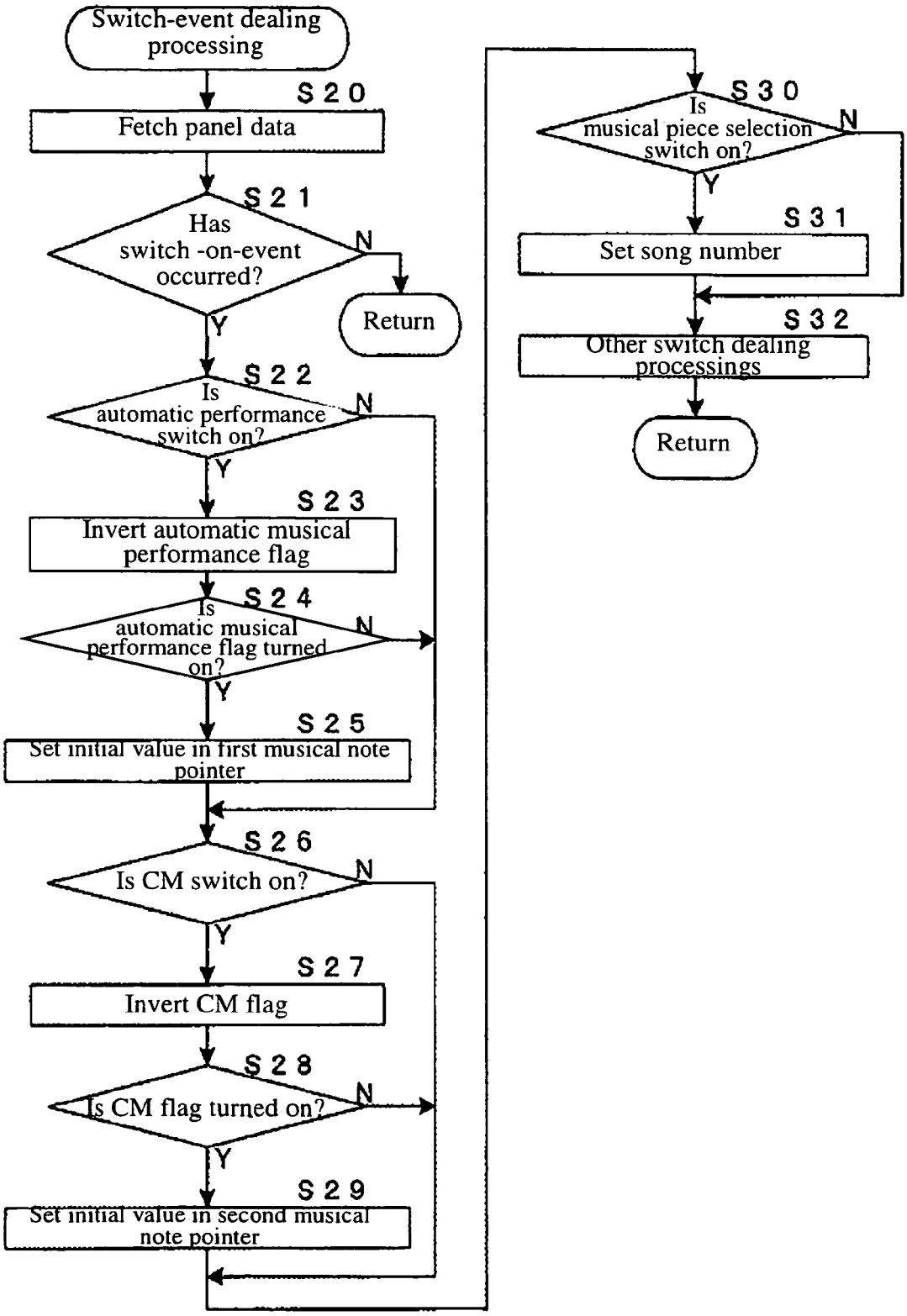
FIG. 7 is a flowchart showing a switch-event processing.
Figure 8:
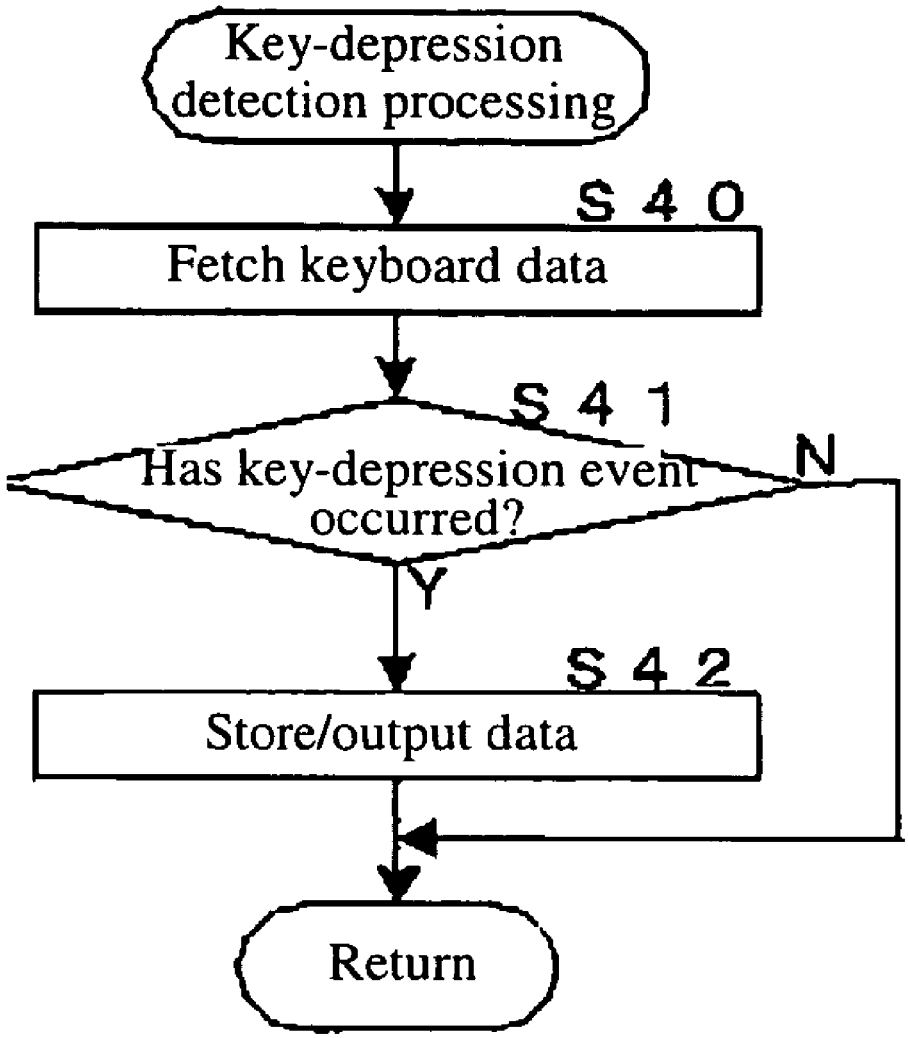
FIG. 8 is a flowchart showing a key-depression detection processing.

Now, the operation of the automatic musical performance device according to this embodiment of the present invention, which is constructed as described above, will be described, referring to the flowcharts shown in FIG. 6 through FIG. 8.

(1-1) Main Process

Figure 6:
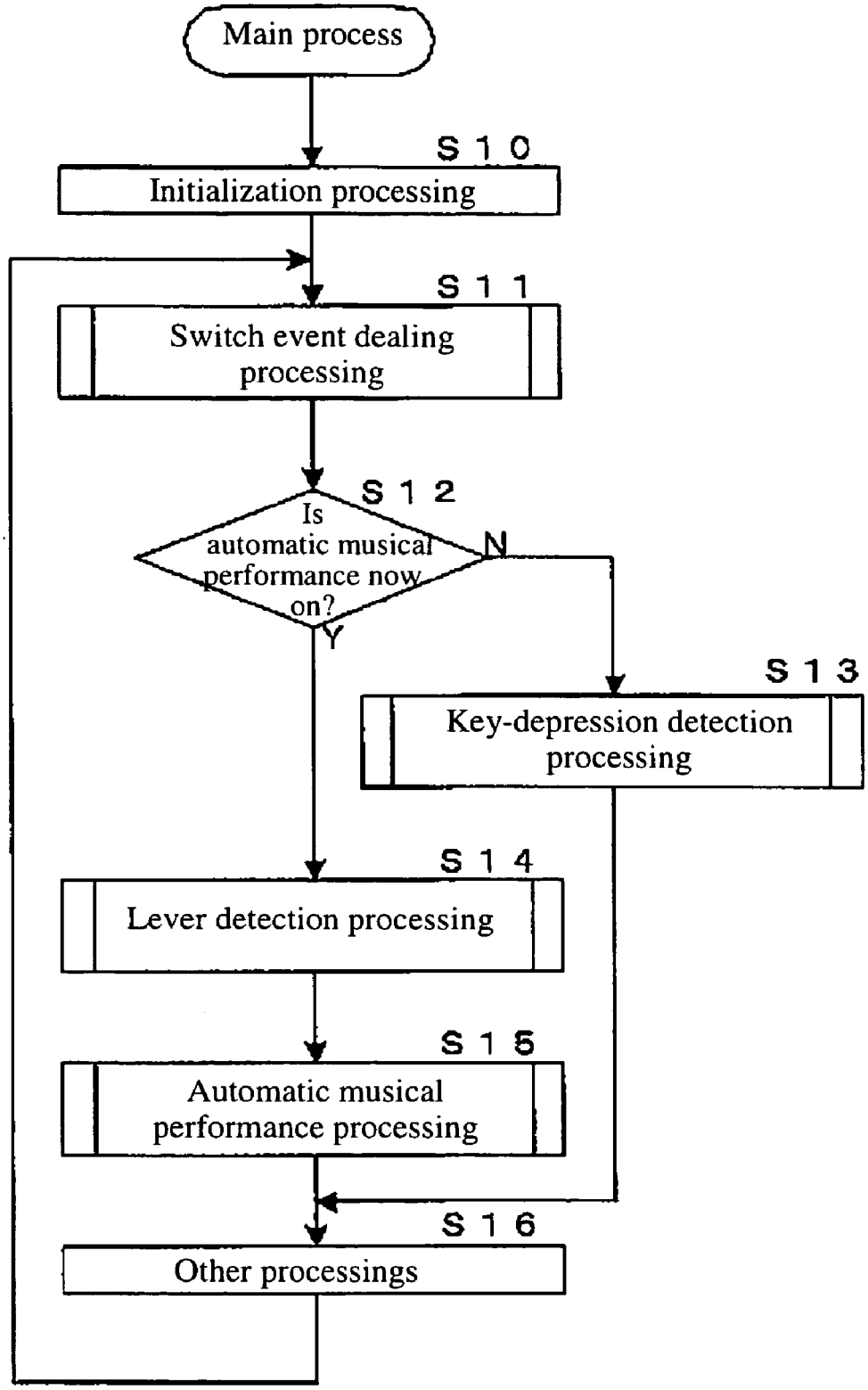
FIG. 6 is a flowchart showing the main process of the device according to Embodiment 1.

FIG. 6 is a flowchart showing the main process of the automatic musical performance device. This main process is started by application of power or turning on an unshown reset switch. In the main process, an initialization processing is performed at first (Step S10). In the initialization processing, the hardware in the CPU 11 is initialized, and the registers, the counters, the flags and the like defined in the work memory 13 are set at initial values.

When the initialization processing is completed, a switch event dealing processing is performed next (Step S11). In the switch event dealing processing, it is determined whether an event has occurred or not in connection with the automatic performance switch 151, the CM switch 152, the musical piece selection switch 153 and other switches. If an event has occurred, processing is preformed so as to correspond to that event. Details of the switch event dealing processing will be described later.

In the main process, it is next checked whether an automatic musical performance is being presented or not (Step S12). If no automatic musical performance is presented, it is determined that a player is playing live music. The processing moves to a key-depression detection processing (Step S13). When the key-depression detection processing is completed, the processing moves to other processings (Step S16).

On the other hand, if an automatic musical performance is being presented, a lever detection processing is performed (Step S14). In the lever detection processing, it is detected whether the lever 19 has been depressed or not. If the automatic musical performance device is set in the CM mode when it is detected that the lever has been depressed, the processing to proceed with an automatic musical performance is performed. Details of the lever detection processing will be described later.

Next, an automatic musical performance processing is performed (Step S15). In the automatic musical performance step, the processing for the normal automatic musical performance or the concert magic performance is preformed. Specifically, when the automatic musical performance flag is turned on, the processing for the normal automatic musical performance is presented, and when the CM flag is also turned on, the processing for concert magic performance is also presented. Accordingly, this automatic musical performance device can present the normal automatic musical performance and the concert magic performance in parallel.

Next, the "Other processings" are performed (Step S16). In the "Other processings", processings other than the above-mentioned processings, such as a processing requiring a periodical check in the main process as in a processing for realizing a special actuation when a switch is continuously depressed, are performed. After that, the main process returns to Step S11, and the processings of Steps S11 to S16 are repeated. When an event has occurred during such repeated processings, the processing corresponding to that event is performed, realizing various kinds of functions as the automatic musical performance device accordingly.

(1-2) Switch Event Dealing Processing

Now, details of the switch event dealing processing, which is performed in Step S11 of the main process routine, will be described, referring to the flowchart shown in FIG. 7.

In the switch event dealing processing, the CPU 11 fetches a panel data from the panel interface circuit 14 at first (Step S20). The fetched panel data is stored, as a new panel data, in a new panel data register defined in the work memory 13. Next, it is checked whether a switch-on-event has occurred or not (Step S21). Specifically, the new panel data is compared with the previous panel data that has been fetched in the previous switch event dealing processing and has been stored in a previous panel data register defined in the work memory 13. Based on this comparison, it is checked whether there is any bit, which had been "0" in the previous panel data and has changed to "1" in the new panel data. When it is determined that no switch-on-event has occurred, the sequence returns to the main process routine.

On the other hand, when it is determined in Step S21 that a switch-on-event has occurred, it is checked whether an on-event has occurred in connection with the automatic performance switch 151 or not (Step S22). When it is determined that an on-event has occurred in connection with the automatic performance switch 151, the automatic performance flag is inverted (Step S23). This arrangement can realize a function of alternately repeating the start and the stop of the normal automatic musical performance whenever the automatic performance switch 151 is depressed.

Next, it is checked whether the automatic musical performance flag is turned on as the result of the inversion of the automatic musical performance flag (Step S24). When it is determined that the automatic musical performance flag has been turned on, it is considered that it is requested to start the normal automatic musical performance. As a result, an initial value is set in the first musical note data pointer (Step S25). Specifically, the initial address of the automatic musical performance data memory 16, to which the automatic musical performance data for the normal automatic musical performance designated by the content of the first song number register is assigned, is stored in the first musical note data pointer. When it is determined in Step S24 that the automatic musical performance flag has been turned off, the processing of Step S25 is skipped. When it is determined in Step S22 that no on-event has occurred in connection with the automatic performance switch 151, the processings of Steps S23 to S25 are also skipped.

Next, it is checked whether an on-event has occurred in connection with the CM switch 152 or not (Step S26). When it is determined that an on-event has occurred in connection with the CM switch 152, the CM flag is inverted (Step S27). This arrangement can realize a function of alternately repeating the start and the stop of the concert magic performance whenever the CM switch 152 is depressed.

Next, it is checked whether the CM flag has been turned on or not as the result of the inversion of the CM flag (Step S28). When it is determined that the CM flag has been turned on, it is considered that it is requested to start the concert magic performance. As a result, an initial value is set in the second musical note data pointer (Step S29). Specifically, the initial address of the automatic musical performance data memory 16, to which the automatic musical performance data for the concert magic performance specified by the content of the second song number register is assigned, is stored in the second musical note data pointer. When it is determined in Step S28 that the CM flag has been turned off, the processing of Step S29 is skipped. When it is determined in Step S26 that no on-event has occurred in connection with the CM switch 152, the processings of Steps S27 to S29 are also skipped.

Next, it is checked whether an event has occurred in connection with the musical piece selection switch 153 or not (Step S30). This operation is performed by checking whether the latest value set in the musical piece selection switch 153 has changed or not. When it is determined that an event has occurred in connection with the musical piece selection switch 153, the relevant song number is set in the relevant song number register (Step S31). Specifically, when the value specified by the musical piece selection switch 153 is one of from 1 to 500, the value is set in the first song number register, and when the value is one of from 501 to 999, the value is set in the second song number register. When it is determined in Step S30 that no event has occurred in connection with the music piece selection switch 153, the processing of Step S31 is skipped.

Next, other switch dealing processing is performed (Step S32). In the other switch dealing processing, switch-event dealing processing other than the above-mentioned processings are performed. At the last stage of the other switch dealing processing, the new panel data is written in the previous panel data register, completing the switch-event dealing step.

(1-3) Key-Depression Detection Processing

Now, details of the key-depression detection processing performed in Step S13 of the main process routine will be described, referring to the flowchart shown in FIG. 8. This processing is utilized when a musical piece, which has been played, is recorded, followed by reproducing the recorded musical piece, outputting the recorded musical piece in the MIDI format, or performing another operation. In this processing, a normal piano performance is presented according to the relevant key-depression.

In the key-depression detection processing, the CPU 11 fetches a keyboard data from the key-depression detection circuit 17 at first (Step S40). The fetched keyboard data is stored, as a new keyboard data in a new-keyboard-data register defined in the work memory 13. Next, it is checked whether a key-depression event has occurred or not (Step S41). Specifically, the new keyboard data is compared to a previous keyboard data, which had been fetched in the previous keyboard event dealing step and has been stored in a previous-keyboard-data register defined in the work memory 13. Based on this comparison, it is checked whether "0" in the previous keyboard data has changed to "1" in the new keyboard data or not. When it is determined that no key-depression event has occurred, the sequence returns to the main process routine.

On the other hand, when it is determined in Step S41 that a key-depression event has occurred, the related data is stored or output according to the keyboard data (Step S42).

(1-4) Lever Detection Processing

Now, details of the lever depression detection processing performed in Step S14 of the main process will be described, referring to the flowchart shown in FIG. 9.

In the lever detection processing, the CPU 11 fetches detection signals from the two-point switch 18*a* and 18*b* at first (Step S50). The fetched detection signals are stored, as new detection signals, in a new-detection-signal register defined in the work memory 13. Next, it is checked whether an event has occurred or not in connection with operation of a commanding member (Step S51). Specifically, the new detection signals are compared to previous detection signals, which had been fetched in the previous event processing for operation of the commanding member and have been stored in a previous-detection-signal register defined in the work memory 13. Based on this comparison, it is checked whether "0" in the previous detection signals has changed to "1" in the new detection signals or not. When it is determined that no event has occurred in connection with operation of the commanding member, the sequence returns to the main process routine.

On the other hand, when it is determined in Step S51 that an event has occurred in connection with the operation of the commanding member, it is checked whether the automatic musical performance device is set in the CM mode or not (Step S52). This operation is performed by referring to the CM flag. When it is determined that the automatic musical performance device is not set in the CM mode, it is considered that the lever 19 is depressed in such a state that the automatic musical performance device is not set in the CM mode. Then, the sequence returns to the main process routine.

On the other hand, when it is determined in Step S52 that the automatic musical performance device is set in the CM mode, it is considered that the lever 19 is depressed in such a state that the automatic musical performance device is set in the CM mode. Then, the performance request flag is set (Step S53). After that, the sequence returns to the main process routine. By the above-mentioned processings, the performance request flag is set when the lever 19 is depressed in the CM mode.

Figure 9:
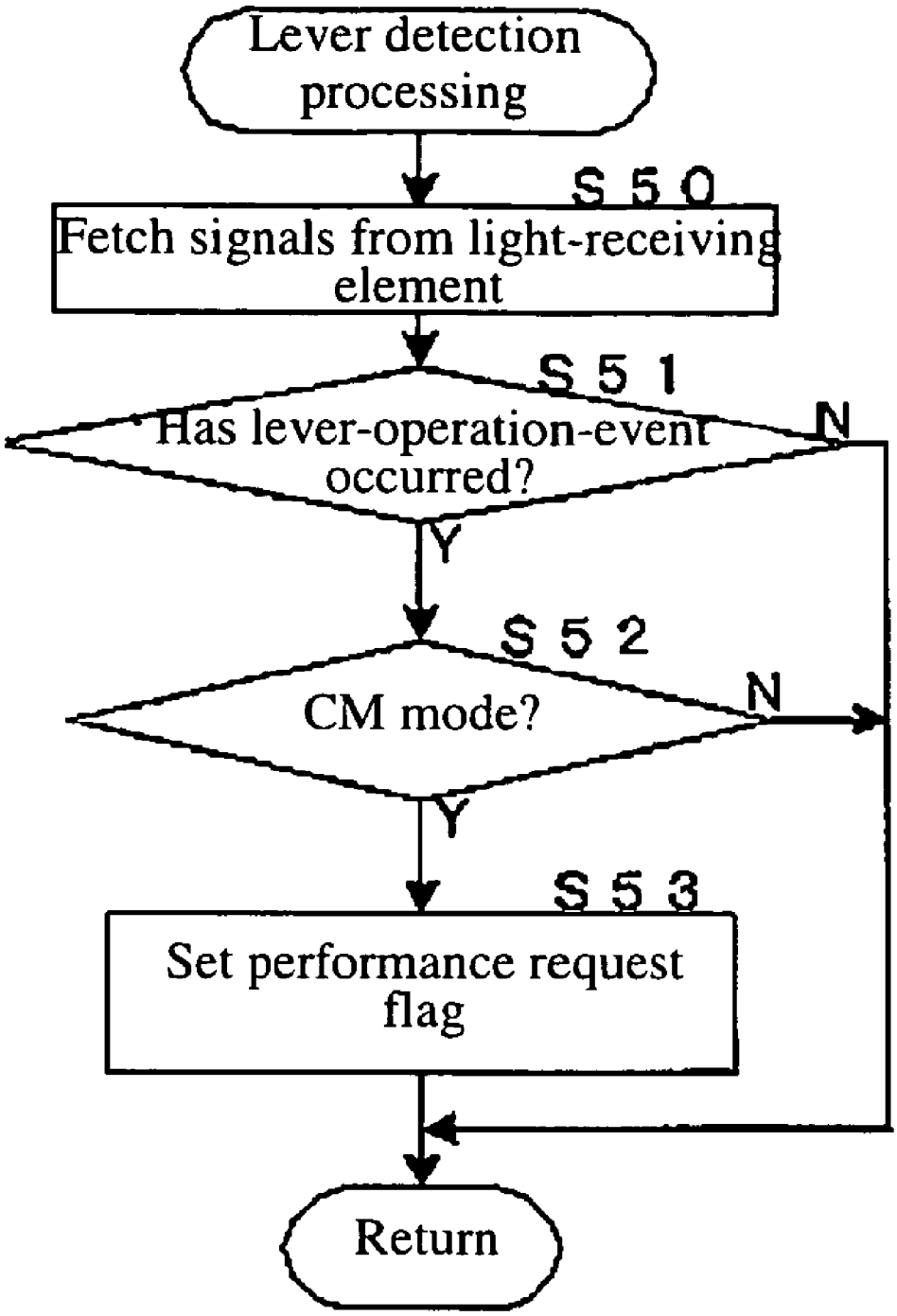
FIG. 9 is a flowchart showing a lever detection processing.

Although the processing that is performed in a case where the lever 19 is released is omitted from the flowchart shown in FIG. 9, the content of the previous-detection-signal register is cleared to zero in that case.

(1-5) Automatic Musical Performance Processing

Figure 10:
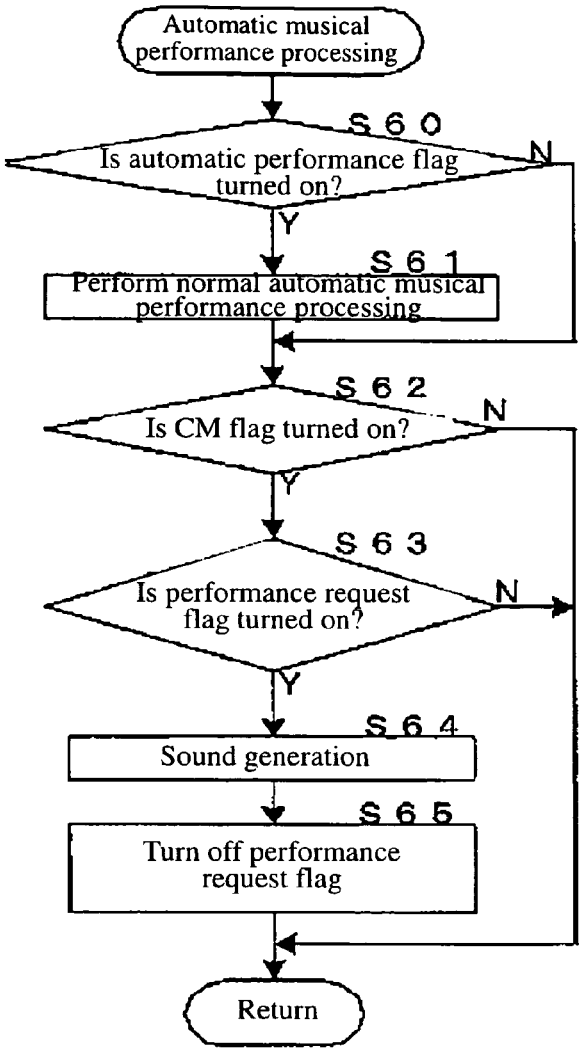
FIG. 10 is a flowchart showing an automatic musical performance processing.

Now, details of the automatic musical performance processing, which is performed in Step S15 of the main process will be described, referring to the flowchart shown in FIG. 10.

The automatic musical performance processing comprises the normal automatic musical performance processing (Steps S60 and S61) and the concert magic performance processing (Steps S62 to S65).

In the normal automatic musical performance processing, it is first checked whether the automatic performance flag is turned on or not (Step S60). When it is determined that the automatic musical performance flag is turned on, the normal automatic musical performance processing is performed (Step S61). In the normal automatic musical performance processing, the CPU 11 reads out musical note data from the position of the automatic performance data memory 16 designated by the first musical note data pointer and checks whether the time designated by a step time contained in the musical note data, i.e., the sound generation timing has come or not.

When it is determined that the sound generation timing has come, the sound generation processing is performed. The sound generation processing produces a signal, which is used to activate a key with intensity designated by the "velocity" contained in the musical note data, the key being specified by the "key number" contained in the musical note data. The signal is transmitted to the solenoid activating circuit. The solenoid activating circuit 20 produces a driving signal, which comprises a current in an amount proportional to the velocity. The solenoid activating circuit transmits the driving signal to the solenoid corresponding to the key designated by the key number. Thus, the key-depression mechanism 40 that corresponds to the key designated by the key number of the musical note data is activated to the relevant chord with intensity designated by the velocity of the musical note data, generating a sound corresponding to the musical note data. After that, the contents of the first musical note data pointer are updated to designate the next musical note data. When the sound generation timing has not come, no sound generation processing is performed in Step S61.

When it is determined in Step S60 that the automatic musical performance flag is not turned on, the processing of Step S61 is skipped. Thus, the normal automatic musical performance processing is completed. The automatic musical performance processing routine is periodically called from the main process routine. Accordingly, the processing, wherein the musical note data forming the automatic musical performance data are sequentially read out from the top, and wherein sound generation is performed when the sound generation timing of the read-out musical note data has come, is repeatedly performed. Thus, the normal automatic musical performance is presented by the acoustic piano.

When the normal automatic musical performance processing is completed, the processing for the concert magic performance is performed next. In the processing for the concert magic performance, it is first checked whether the CM flag has been turned on or not (Step S62). When it is determined that the CM flag has not been turned on, it is considered that the automatic musical performance device is not set in the CM mode. The sequence returns to the main process routine without performing the sound generation processing.

When it is determined in Step S62 that the automatic musical performance device is set in the CM mode, it is checked whether the performance request flag is turned on or not, i.e., whether the lever 19 has been depressed or not (Step S63). When it is determined that the performance request flag is not turned on, the sequence returns to the main process routine without performing the sound generation processing.

When it is determined in Step S63 that the performance request flag is turned on, the sound generation processing is performed next (Step S64). In the sound generation processing, the CPU 11 reads out musical note data from the position of the automatic musical performance data memory 16 designated by the second musical note data pointer. The CPU produces a signal, which activates a key with the intensity corresponding to the velocity value fv(Tv, Tmp) found as described above, the key being designated by the "key number" contained the read-out musical note data. The CPU 11 transmits the signal to the solenoid activating circuit 20 under such timing control that the transmission timing Ton comes at the time of the lapse of "fa(Tv)−fD(Tv)" sec found as described above, after detection of the signal $S_2$.

The solenoid activating circuit 20 produces a driving signal, which comprises a current in the amount proportional to the velocity, and the solenoid activating circuit transmits the driving signal to the solenoid corresponding to the key designated by the key number. Thus, the key-depression mechanism 40 corresponding to the key designated by the key number of the musical note data is activated to strike the related chord with the intensity corresponding to the velocity value, generating the sound corresponding to the musical note data. After that, the content of the second musical note data is updated to designate a next musical note data.

Next, the performance request flag is turned off (Step S65). Thus, the sound generating processing of Step S64 is not performed until the lever 19 is newly depressed as well as the performance request flag is turned on. After that, the sequence returns to the main process routine.

The above-mentioned operations realize the concert magic performance, wherein whenever the lever 19 is depressed, musical note data are read out from the automatic musical performance data memory 19, generating sound. As described above, in accordance with the automatic musical performance device according to the embodiment of the present invention, it is possible to present a powerful automatic musical performance since the concert magic performance can be presented by an acoustic piano whenever the lever 19 is depressed. In the automatic musical performance, the performance control unit formed by the CPU 11 transmits each operating signal to the solenoid activating circuit 20 under such timing control that the transmission timing comes at the time of the lapse of "fa(Tv)−fD(Tv)" sec after detection of the signal $S_2$. At the time of the lapse of the delay time fD(Tv), the performance by an acoustic piano starts. Since the lever 19 has depressed to the lowest poison at that time, the time lag, which is from activation of any one of the solenoids $\mathbf{21}_1$ to $\mathbf{21}_n$ after reception of the operating signal to sound generation, is accordingly cancelled so that a player can enjoy the automatic musical performance with the concert magic function while playing the piano with a feeling of normally playing the piano.

The velocity value is modified to the value of fv(Tv, Tmp) based on the calculated tempo Tmp. Accordingly, even if a musical piece is played at a fast tempo, it is possible to enjoy the automatic musical performance with the concert magic function while playing a piano without preventing the velocity from being too large and without feeling discomfort.

Embobiment 2

Figure 11:
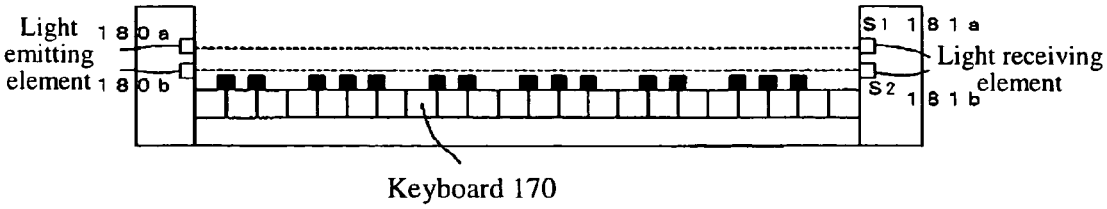
FIG. 11 is a schematic view showing the structure of the detector according to Embodiment 2, which is disposed on an acoustic piano.

In the structure of Embodiment 2, the detection unit comprises, instead of the two-point switch 18*a* and 18*b* in Embodiment 1, light emitting elements 180*a* and 180*b*, and light receiving elements 181*a* and 181*b*, the respective pairs of which are disposed at upper and lower positions to scan light in a horizontal direction at two upper and lower points just above the keyboard 170 as shown in FIG. 11. In this case, when a player swings a finger, a hand or the like above the keyboard 170 without contact with the keyboard, the light receiving elements 181*a* and 181*b* at the two points fail to receive light, thereby detecting the operation of the player.

Figure 12:
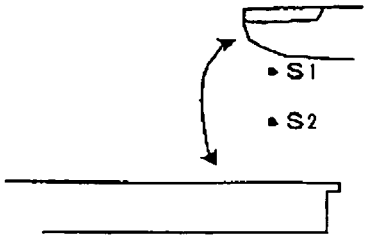
FIG. 12 is a schematic view showing how signal direction is made when a player plays in Embodiment 2.
Figure 13:
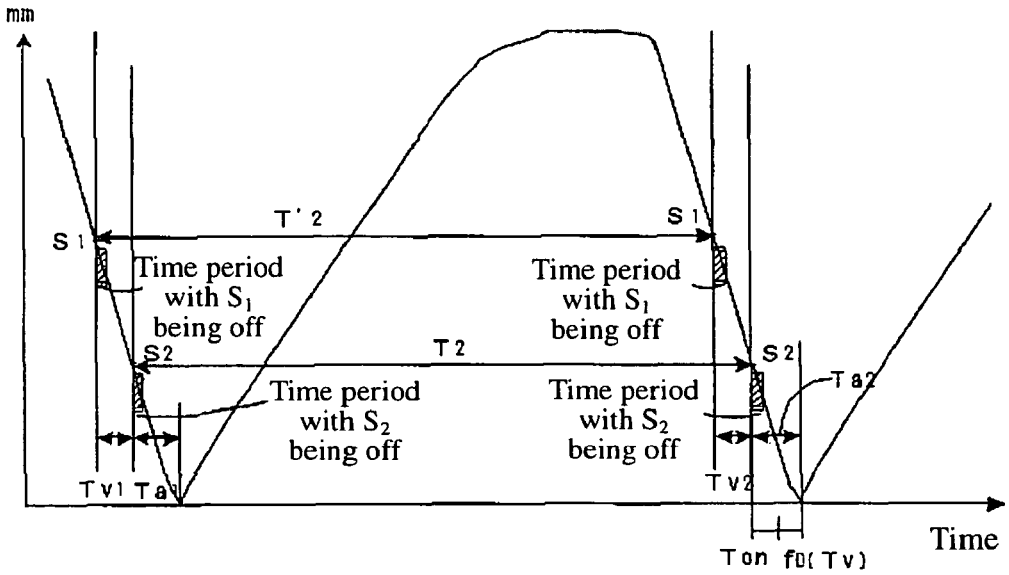
FIG. 13 is a timing chart showing the switch timing in Embodiment 2.

Based on the respective detection signals from the detection unit, the CPU 11 forming the performance control unit finds the time interval between the detection signals as a detection value Tv as shown in FIG. 12 and FIG. 13. And, the CPU 11 further finds the tempo Tmp. When the time internal Tv and the tempo Tmp are found, a processing similar to Embodiment 1 is performed. In other words, as in Embodiment 1, the delay time fD(Tv), which is from reception of each operating signal by the solenoid activating circuit 20 as the performance activating unit to commencement of actual performance that the acoustic piano plays with solenoids, is found, referring to the relevant function or data map table, by the CPU 11. A time period Ta, which starts when it is detected that the light reception by the lower light receiving element 181*b* is interrupted and which ends when the operation has reached the lowest level and has stopped, is found as fa(Tv) based on the relevant function or data map table by the CPU 11. After that, the CPU 11 transmits an operating signal to the solenoid activating circuit 20 under such timing control that the transmission timing Ton comes at a time of the lapse of "fa(Tv)−fD(Tv)" sec after it is detected that the light reception by the lower light receiving element 181*b* is interrupted.

In accordance with the above-mentioned structure, it is possible to form the detection unit by disposing the light emitting elements 180*a* and 180*b*, and the light receiving elements 181*a* and 181*b* at the two upper and lower points just above the keyboard 170 even without using the lever 19 and the two-point switch 18*a* and 18*b* as in Embodiment 1.

Embodiment 3

In the structure of each of Embodiments 1 and 2 described above, the value of the transmission timing Ton, which is equal to the value of "fa(Tv)−fD(Tv)" is negative, making the tempo fast, in some cases. In the structure of Embodiment 3, each operating signal is transmitted at next beat timing with a delay of one beat $T_2$ in that case.

Figure 14:
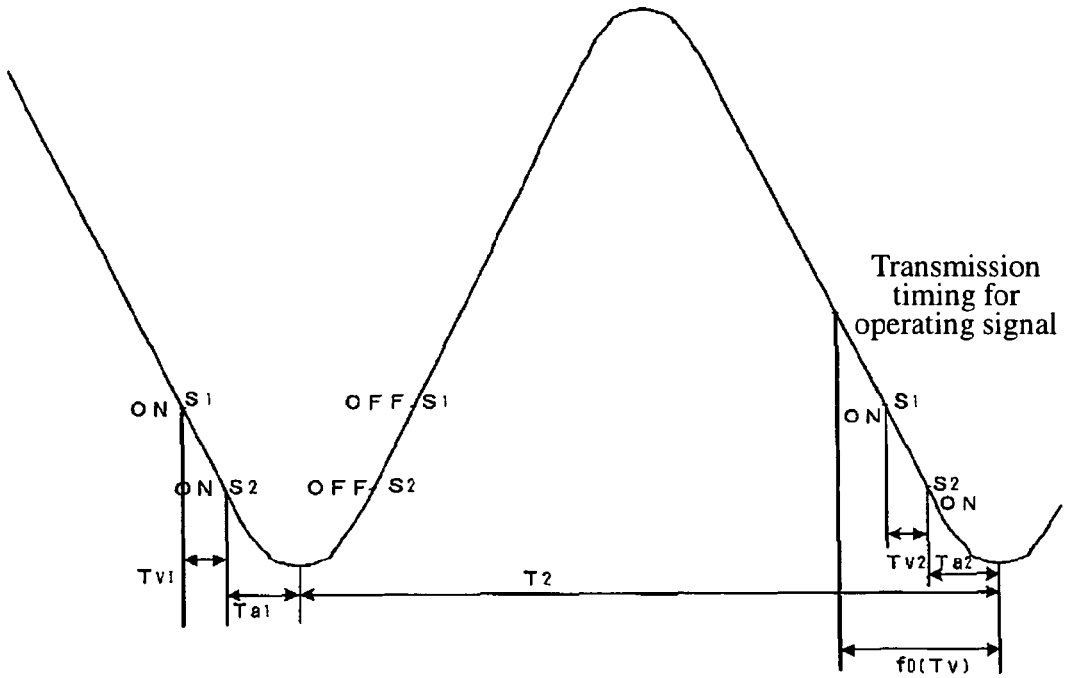
FIG. 14 is a timing chart showing the state of the transmission timing of an operating signal in Embodiment 3.

Specifically, in accordance with the structure according to this embodiment, when the value of the transmission timing Ton found by the CPU 11 forming the performance control unit is negative, each operating signal is transmitted to the solenoid activating circuit 20 under such timing control that the transmission timing comes at the time of the lapse of "fa(Tv)+$T_2$−fD(Tv)" sec after later detection of the signals at the two points as the reference as shown in FIG. 14. Thus, the current operation of the commanding member reflects on the performance presented in one beat, being capable of eliminating the above-mentioned timing lag.

It should be noted that the one beat $T_2$ may be a time difference between first two-point detection (detection at one of the two points or detection at the other point in first detection) and second two-point detection (detection at one of the two points or detection at the other point in second detection) or the average value of the time differences between adjacent beats detected several beats before, as in the above-mentioned tempo Tmp.

On the other hand, even when the automatic musical performance device is configured as in Embodiment 3, the automatic musical performance device is problematic, in some cases, in that a musical performance is presented by one beat without a pause when the return operation of the lever 19 or the key release operation of the keyboard 170 is suddenly stopped.

In order to ease this problem, this embodiment is configured so that a next operating signal is transmitted after detecting the return operation of the lever 19 or the key release of the keyboard 170. Specifically, on the assumption that the detection unit is configured to make two-point detection so that the first detection is made by the switch $S_1$ and the second detection is made by the switch $S_2$, the CPU 11 transmits an operating signal only when it is detected that $S_1$ is turned off in such a sequence that S1 is turned on, $S_2$ is turned on, the transmission of an operating signal at a next beat is prepared, $S_2$ is turned off, $S_1$ is turned off and the operating signal is transmitted. In other words, when the CPU 11 detects that the switch $S_1$ is turned off, each operating signal is transmitted to the solenoid activating circuit 20 under the above-mentioned timing control. In accordance with this arrangement, a musical performance is not presented at a next beat for a pause when the lever 19 or a key on keyboard 170 is suddenly held, being kept depressed.

It should be noted that the automatic musical performance device according to the present invention is not limited to the embodiments described above and shown. It is understood that changes and variations may be made without departing from the spirit of the present invention.

INDUSTRIAL APPLICABILITY

The automatic musical performance device according to the present invention is widely applicable to an acoustic instrument so that a musical performance utilizing the concert magic function can be presented with a feeling of normally playing the acoustic instrument.

The invention claimed is:

1. An automatic musical performance device comprising:

a musical instrument capable of presenting an acoustic performance;

a performance actuator for actuating the musical instrument based on an operating signal from outside;

a memory unit for storing automatic musical performance data wherein a plurality of musical note data are arranged in the order of sound generation;

a command unit for commanding progress of an automatic musical performance;

a commanding member equipped with the instrument and being capable of being operated by a player;

a detector for detecting an operational action of the commanding member between at least two points; and a musical performance operation control unit, which has functions or data map tables stored therein, which makes a calculation on detection results based on mapping relationships in the functions or the data map tables, which sequentially reads out musical note data forming an automatic musical performance data from the memory unit whenever the command unit gives a command, and which outputs each operating signal to the performance actuator based on the read-out musical note data and the calculated values;

wherein the musical performance operation control unit finds a time period Tv between the two points based on detection by the detector; a delay time fD(Tv), which is from reception of each operating signal by the performance actuator to commencement of an actual musical performance of the musical instrument by the performance actuator, is found based on the mapping relationship in a function or a data map table; a time period Ta, which starts when later detection of the detection is made and ends when the operational action of the commanding member is stopped, is found as fa(Tv) based on the mapping relationship in a function or a data map table; and each operating signal is transmitted to the performance actuator under such timing control that a transmission timing Ton comes at a time of lapse of "fa(Tv)−fD(Tv)" sec after the later detection.

2. An automatic musical performance device comprising:

a musical instrument capable of presenting an acoustic performance;

a performance actuator for actuating the musical instrument based on an operating signal from outside;

a memory unit for storing automatic musical performance data wherein a plurality of musical note data are arranged in the order of sound generation;

a command unit for commanding progress of an automatic musical performance;

a commanding member equipped with the instrument, being capable of being operated by a player and being similar to a keyboard having a longer stroke than an ordinary keyboard;

a detector for detecting an operational action of the commanding member between at least two points, which are spaced in the stroke; and a musical performance operation control unit, which has functions or data map tables stored therein, which makes a calculation on detection results based on mapping relationships in the functions or the data map tables, which sequentially reads out musical note data forming an automatic musical performance data from the memory unit whenever the command unit gives a command, and which outputs each operating signal to the performance actuator based on the read-out musical note data and the calculated values;

wherein the performance control unit finds, as detection values Tv, time intervals between detection signals based on the detection signals detected at the two points by the detector; a delay time fD(Tv), which is from reception of each operating signal by the performance actuator to commencement of an actual musical performance of the musical instrument by the performance actuator, is found based on the mapping relationship in a function or a data map table; a time period Ta, which starts when later detection of the detection is made and ends when the operational action of the commanding member is stopped, is found as fa(Tv) based on the mapping relationship in a function or a data map table; and each operating signal is transmitted to the performance actuator under such timing control that a transmission timing Ton comes at a time of lapse of "fa(Tv)−fD(Tv)" sec after the later detection.

3. An automatic musical performance device comprising:

a musical instrument capable of presenting an acoustic performance;

a performance actuator for actuating the musical instrument based on an operating signal from outside;

a memory unit for storing automatic musical performance data wherein a plurality of musical note data are arranged in the order of sound generation;

a command unit for commanding progress of an automatic musical performance;

a detector comprising light emitting elements and light receiving elements, two pairs of which are located at two upper and lower positions to scan light in a horizontal direction at the two upper and lower positions above a playing portion of the musical instrument in order to detect an operational action of a player by preventing the scanned light from being received by the light receiving elements at the two positions; and a musical performance operation control unit, which has functions or data map tables stored therein, which makes a calculation on detection results based on mapping relationships in the functions or the data map tables, which sequentially reads out musical note data forming an automatic musical performance data from the memory unit whenever the command unit gives a command, and which outputs each operating signal to the performance actuator based on the read-out musical note data and the calculated values;

wherein the performance control unit finds, as a detection values Tv, time intervals between detection signals based on the detection signals detected by the detector; a delay time fD(Tv), which is from reception of each operating signal by the performance actuator to commencement of an actual musical performance of the keyboard instrument by the performance actuator, is found based on the mapping relationship in a function or a data map table; a time period Ta, which is equal to be half a time period starting when a lower light receiving element is prevented from receiving the scanned light and ending when the lower light receiving element is prevented from receiving the scanned light again by inversion of the operational action of the player, is found as fa(Tv) based on the mapping relationship in a function or a data map table; and each operating signal is transmitted to the performance actuator under such timing control that a transmission timing Ton comes at a time of lapse of "fa(Tv)−fD(Tv)" sec after the lower light receiving element is prevented from receiving the scanned light.

4. An automatic musical performance device comprising:

a musical instrument capable of presenting an acoustic performance;

a performance actuator for actuating the musical instrument based on an operating signal from outside;

a memory unit for storing automatic musical performance data wherein a plurality of musical note data are arranged in the order of sound generation;

a command unit for commanding progress of an automatic musical performance;

a commanding member equipped with the instrument and being capable of being operated by a player;

a detector for detecting an operational action of the commanding member between at least two points; and a musical performance operation control unit, which has functions or data map tables stored therein, which makes a calculation on detection results based on mapping relationships in the functions or the data map tables, which sequentially reads out musical note data forming an automatic musical performance data from the memory unit whenever the command unit gives a command, and which outputs each operating signal to the performance actuator based on the read-out musical note data and the calculated values;

wherein the musical performance operation control unit finds a time period Tv between two points, time intervals between two-point detection and later two-point detection and a tempo Tmp found by averaging the time intervals, based on detection signals at the two points and later detection signals at the two points; a delay time fD(Tv), which is from reception of each operating signal by the performance actuator to commencement of an actual musical performance of the musical instrument by the performance actuator, and a velocity value fv(Tv, Tmp) are found based on mapping relationships in the functions or the data map tables; a time period Ta, which starts when later detection of the two-point detection as a reference is made and ends when the operational action of the commanding member is stopped, is found as fa(Tv) based on a mapping relationship in the functions or the data map tables; each operating signal is transmitted to the performance actuator under such timing control that a transmission timing Ton comes at a time of lapse of "fa(Tv)−fD(Tv)" sec after the later detection; and the velocity value is set at fv(Tv, Tmp).

5. The automatic musical performance device according to claim 4, wherein the commanding member is similar to a keyboard having a longer stroke than an ordinary keyboard, the detector detects the operational action of the commanding member at two points, which are spaced in the stroke, and the performance control unit finds, as detection values Tv, time intervals between detection signals based on the detection signals detected at the two points by the detector.

6. The automatic musical performance device according to claim 4, wherein the detector comprises light emitting elements and light receiving elements, two pairs of which are located at two upper and lower positions to scan light in a horizontal direction at the two upper and lower positions above a playing portion of the musical instrument in order to detect an operational action of a player by preventing the scanned light from being received by the light receiving elements at the two positions; and the performance control unit finds, as a detection values Tv, time intervals between detection signals based on the detection signals.

7. An automatic musical performance device comprising:

a musical instrument capable of presenting an acoustic performance;

a performance actuator for actuating the musical instrument based on an operating signal from outside;

a memory unit for storing automatic musical performance data wherein a plurality of musical note data are arranged in the order of sound generation;

a command unit for commanding progress of an automatic musical performance;

a commanding member equipped with the instrument and being capable of being operated by a player;

a detector for detecting an operational action of the commanding member between at least two points; and a musical performance operation control unit, which has functions or data map tables stored therein, which makes a calculation on detection results based on mapping relationships in the functions or the data map tables, which sequentially reads out musical note data forming an automatic musical performance data from the memory unit whenever the command unit gives a command, and which outputs each operating signal to the performance actuator based on the read-out musical note data and the calculated values;

wherein the musical performance operation control unit finds a time period Tv between two points, time intervals between two-point detection and later two-point detection and a tempo Tmp found by averaging the time intervals, based on detection signals at the two points and later detection signals at the two points; a delay time fD(Tv), which is from reception of each operating signal by the performance actuator to commencement of an actual musical performance of the musical instrument by the performance actuator, and a velocity value fv(Tv, Tmp) are found based on mapping relationships in the functions or the data map tables; a time period Ta, which starts when later detection of the two-point detection as a reference is made and ends when the operational action of the commanding member is stopped, is found as fa(Tv) based on a mapping relationship in the functions or the data map tables; in case where it is assumed that a transmission timing Ton, when the operating signal is transmitted after later detection, is at a time of lapse of "fa(Tv)−fD(Tv)" sec after the later detection, when the transmission timing has a negative value, each operating signal is transmitted to the performance actuator with a delay of one beat $T_2$ under such timing control that the transmission timing Ton comes at a time of lapse of "fa(Tv)+$T_2$−fD(Tv)" sec after the later detection in the two-point detection as the reference; and the velocity value is set at fv(Tv, Tmp).

8. The automatic musical performance device according to claim 7, wherein the commanding member is similar to a keyboard having a longer stroke than an ordinary keyboard, the detector detects the operational action of the commanding member at two points, which are spaced in the stroke, and the performance control unit finds, as detection values Tv, time intervals between detection signals based on the detection signals detected at the two points by the detector.

9. The automatic musical performance device according to claim 7, wherein the detector comprises light emitting elements and light receiving elements, two pairs of which are located at two upper and lower positions to scan light in a horizontal direction at the two upper and lower positions above a playing portion of the musical instrument in order to detect an operational action of a player by preventing the scanned light from being received by the light receiving elements at the two positions; and the performance control unit finds, as a detection values Tv, time intervals between detection signals based on the detection signals.

10. An automatic musical performance device comprising:

a musical instrument capable of presenting an acoustic performance;

a performance actuator for actuating the musical instrument based on an operating signal from outside;

a memory unit for storing automatic musical performance data wherein a plurality of musical note data are arranged in the order of sound generation;

a command unit for commanding progress of an automatic musical performance;

a commanding member equipped with the instrument and being capable of being operated by a player;

a detector for detecting an operational action of the commanding member between at least two points; and a musical performance operation control unit, which has functions or data map tables stored therein, which makes a calculation on detection results based on mapping relationships in the functions or the data map tables, which sequentially reads out musical note data forming an automatic musical performance data from the memory unit whenever the command unit gives a command, and which outputs each operating signal to the performance actuator based on the read-out musical note data and the calculated values;

wherein whenever the detector is turned on, signals are detected at the respective points; when it is detected that all detection signals are off, detection signals at the two points and later detection signals at the two points are formed; the musical performance operation control unit finds a time period Tv between two points, time intervals between two-point detection and later two-point detection and a tempo Tmp found by averaging the time intervals, based on the detection signals at the two points and the later detection signals at the two points; a delay time fD(Tv), which is from reception of each operating signal by the performance actuator to commencement of an actual musical performance of the musical instrument by the performance actuator, and a velocity value fv(Tv, Tmp) are found based on mapping relationships in the functions or the data map tables; a time period Ta, which starts when later detection of the two-point detection as a reference is made and ends when the operational action of the commanding member is stopped, is found as fa(Tv) based on a mapping relationship in the functions or the data map tables; in case where it is assumed that a transmission timing Ton, when the operating signal is transmitted after later detection, comes at a time of lapse of "fa(Tv)−fD(Tv)" sec after the later detection, when the transmission timing has a negative value, each operating signal is transmitted to the performance actuator with a delay of one beat $T_2$ under such timing control that the transmission timing Ton comes at a time of lapse of "fa(Tv)+$T_2$−fD(Tv)" sec after the later detection; and the velocity value is set at fv(Tv, Tmp).

11. The automatic musical performance device according to claim 10, wherein the commanding member is similar to a keyboard having a longer stroke than an ordinary keyboard, the detector detects the operational action of the commanding member at two points, which are spaced in the stroke, and the performance control unit finds, as detection values Tv, time intervals between detection signals based on the detection signals detected at the two points by the detector.

12. The automatic musical performance device according to claim 10, wherein the detector comprises light emitting elements and light receiving elements, two pairs of which are located at two upper and lower positions to scan light in a horizontal direction at the two upper and lower positions above a playing portion of the musical instrument in order to detect an operational action of a player by preventing the scanned light from being received by the light receiving elements at the two positions; and the performance control unit finds, as a detection values Tv, time intervals between detection signals based on the detection signals.

* * * * *